US012595619B2

(12) United States Patent
Kim et al.

(10) Patent No.: US 12,595,619 B2
(45) **Date of Patent: *Apr. 7, 2026**

(54) LAUNDRY TREATING APPARATUS

(71) Applicant: LG Electronics Inc., Seoul (KR)

(72) Inventors: Jaehyung Kim, Seoul (KR); Semin Jang, Seoul (KR); Boram Noh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/773,169

(22) Filed: Jul. 15, 2024

(65) Prior Publication Data

US 2024/0368823 A1 Nov. 7, 2024

Related U.S. Application Data

(63) Continuation of application No. 18/074,913, filed on Dec. 5, 2022, now Pat. No. 12,054,877, which is a (Continued)

(30) Foreign Application Priority Data

Jun. 1, 2018 (KR) ..... 10-2018-0063621
Jun. 1, 2018 (KR) ..... 10-2018-0063622

(51) Int. Cl.
*D06F 58/10* (2006.01)
*D06F 58/20* (2006.01)
*D06F 73/02* (2006.01)

(52) U.S. Cl.
CPC ..... *D06F 73/02* (2013.01); *D06F 58/203* (2013.01); *D06F 58/10* (2013.01); *D06F 58/206* (2013.01)

(58) Field of Classification Search
None
See application file for complete search history.

(56) References Cited

U.S. PATENT DOCUMENTS 11,946,193 B2 * 4/2024 Lee ..... D06F 58/10
12,054,877 B2 * 8/2024 Kim ..... D06F 58/203
(Continued)

FOREIGN PATENT DOCUMENTS

CN 104695195 A 6/2015
CN 204780363 U 11/2015
(Continued)

OTHER PUBLICATIONS

Australian Office Action received from the Australian Government in Australian Application No. 2019203836, dated Oct. 1, 2020 (6 pages).

(Continued)

*Primary Examiner* — Cristi J Tate-Sims
(74) *Attorney, Agent, or Firm* — Birch, Stewart, Kolasch & Birch, LLP

(57) ABSTRACT

A laundry treating apparatus including a cabinet; a laundry receiving space defined in the cabinet and configured for receiving laundry therein; an insertion opening defined in a front face of the cabinet and in fluid communication with the laundry receiving space; a door rotatably fixed to the cabinet to open and close the insertion opening; a supply unit configured to supply at least one of air or water vapor to the laundry receiving space; a support assembly provided in the laundry receiving space and configured to support the laundry; and a conveying part configured to move the support assembly toward the insertion opening when the door opens the insertion opening.

13 Claims, 15 Drawing Sheets

Related U.S. Application Data continuation of application No. 16/427,517, filed on May 31, 2019, now Pat. No. 11,535,976.

(56) References Cited

U.S. PATENT DOCUMENTS

| | | | | |
|---|---|---|---|---|
| 2003/0019087 | A1 | 1/2003 | Pasin et al. | |
| 2008/0155757 | A1* | 7/2008 | Kim | D06F 58/203 8/149.3 |
| 2010/0043500 | A1* | 2/2010 | Yoo | D06F 73/02 68/5 C |
| 2014/0238086 | A1* | 8/2014 | Choi | D06F 58/20 68/20 |
| 2015/0020419 | A1 | 1/2015 | Park et al. | |
| 2015/0159315 | A1* | 6/2015 | Lim | D06F 71/36 38/3 |
| 2017/0327306 | A1 | 11/2017 | Nam et al. | |

FOREIGN PATENT DOCUMENTS

| | | | | |
|---|---|---|---|---|
| CN | 105714541 | A | 6/2016 | |
| CN | 207347805 | U | 5/2018 | |
| EP | 2 826 911 | A1 | 1/2015 | |
| EP | 3 034 684 | A1 | 6/2016 | |
| EP | 3 321 415 | A1 | 5/2018 | |
| EP | 3321413 | A1 * | 5/2018 | D06F 73/02 |
| JP | 47-34352 | | 10/1972 | |
| JP | 54-1527 | U | 1/1979 | |
| JP | 58-81098 | A | 5/1983 | |
| KR | 10-0444005 | B1 | 11/2004 | |
| KR | 10-2011-0048344 | A | 5/2011 | |
| KR | 10-2018-0052955 | A | 5/2018 | |

OTHER PUBLICATIONS

Chinese Office Action received in Chinese Application No. 201910469420.7, dated Aug. 3, 2021 (18 pages).

European Search Report received from the European Patent Office (EPO) in European Application No. 19177662.4, dated Aug. 22, 2019.

Xue Jian et al., China Architecture and Building Press, "Decoration Design and Construction Manual." (2004) (15 pages).

* cited by examiner

LAUNDRY TREATING APPARATUS

CROSS-REFERENCE TO RELATED APPLICATIONS

This application is a Continuation of U.S. application Ser. No. 18/074,913, filed on Dec. 5, 2022 (now U.S. Pat. No. 12,054,877, issued on Aug. 6, 2024), which is a Continuation of U.S. application Ser. No. 16/427,517, filed on May 31, 2019 (now U.S. Pat. No. 11,535,976, issued on Dec. 27, 2022), which claims priority under 35 U.S.C. § 119 to Korean Patent Application No. 10-2018-0063621, filed on Jun. 1, 2018, and Korean Patent Application No. 10-2018-0063622, filed on Jun. 1, 2018, all of which are hereby expressly incorporated by reference into the present application

BACKGROUND

Field of the Invention

The present disclosure relates to a laundry treating apparatus.

Discussion of the Related Art

Typically, a laundry treating apparatus refers to an apparatus that carries out a series of processes (e.g., washing, drying, deodorization, wrinkle removal, etc.) in relation to clothes. The term "clothes treating apparatus" may comprise a washing machine for washing laundry, a dryer for drying wet laundry, a refresher for removing odors or wrinkles out of clothes, and so on.

The development trend of clothes treating apparatuses is toward a single apparatus designed to carry out all of washing, drying, deodorization, and wrinkle removal for clothes. However, existing clothes treating apparatuses are limited in their ability to deodorize or remove wrinkles from clothes because of the use of a drum for receiving clothes and a driver for rotating the drum.

To address the problem, a "clothes treating apparatus" is disclosed in Korean Patent Application No. 10-2013-0150441. FIG. 1 illustrates the configuration of the clothes treating apparatus, as disclosed in Korean Patent Application No. 10-2013-0150441.

Referring to FIG. 1, the clothes treating apparatus includes a cabinet 1 forming the exterior of the clothes treating apparatus, a first chamber 2 providing an accommodation space for accommodating a clothing item therein, a door for opening and closing the cabinet 1, a holding portion 400 provided on the door or in the first chamber 2 for holding the clothing item, a base 4 provided under the holding portion 400 for supporting a surface of the clothing item, a pressing portion 6 rotatably provided on a side surface of the base 4 for pressing the clothing item held on the holding portion 400, and supply portion for feeding hot air or moisture to the first chamber 2.

With a clothing item held in the accommodation space of the cabinet, the clothes treating apparatus may remove odors and wrinkles out of the clothing item by supplying hot air through the supply portion in a lower part of the cabinet or pressing the clothing item.

Further, with the clothing item unfolded inside the cabinet by self-weight, the clothes treating apparatus may dry, deodorize, or flatten the clothing item by feeding hot air or moisture to the clothing item. As the pressing portion presses the surface of the clothing item, wrinkles may be removed from the clothing item or creases may be formed on the clothing item, thereby obviating the need for ironing the clothing item after washing or drying.

In the conventional clothes treating apparatus, however, as the pressing portion 6 presses a clothing item C while rotating from a side surface of the clothing item C, the clothing item C is pressed sequentially from one side surface to the other side surface thereof.

Therefore, relatively high pressure is applied to a part of the clothing item C close to an axis of rotation of the pressing portion 6, whereas relatively low pressure is applied to another part of the clothing item C far from the axis of rotation of the pressing portion 6. As a result, the clothing item C is not pressed uniformly.

Moreover, while the clothing item C is being pressed by the pressing portion 6, the clothing item P is deformed or displaced by the pressing portion 6.

Even though the clothing item C is held on the holding portion 400, the clothing item C does not remain stationary and may move out of place, which may not be prevented during pressing in the conventional clothes treating apparatus.

Therefore, the conventional clothes treating apparatus produces more creases than needed or an unintended crease on the clothing item C.

In addition, as the pressing portion 6 is configured to rotate in a width direction, the pressing portion 6 presses only a specific area of the clothing item C.

Besides, since the conventional clothes treating apparatus is not capable of controlling a height at which the clothing item C is hung in the accommodation space, the conventional clothes treating apparatus fails to press a user-intended area of the clothing item C.

SUMMARY OF THE INVENTION

Accordingly, an aspect of the present disclosure is to provide a laundry treating apparatus configured to prevent deformation or displacement of a clothing item by pressing the clothing item in a length direction.

Another aspect of the present disclosure is to provide a laundry treating apparatus configured to allow a user to control an area to be pressed by controlling a hanging height of a clothing item.

Another aspect of the present disclosure is to provide a laundry treating apparatus which maximizes a pressing effect by pressing a clothing item over an extended area.

Another aspect of the present disclosure is to provide a laundry treating apparatus configured to prevent displacement of a clothing item, even though the clothing item is fixed and pressed.

Another aspect of the present disclosure is to provide a laundry treating apparatus configured to facilitate placement and removal of a clothing item, even though the clothing item may be immobilized with increased fixing force.

Additional advantages, objects, and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

In an aspect of the present disclosure, a laundry treating apparatus may comprise a cabinet including an inlet on a front surface thereof, a door rotatably coupled to the cabinet and configured to open and close the inlet, a first chamber disposed in the cabinet and configured to provide an accommodation space to accommodate a clothing item therein, a supply portion in communication with the first chamber and configured to supply at least one of air or moisture into the accommodation space, and a holding portion disposed in at least one of the first chamber or the door and configured to hold or fix the clothing item in the accommodation space. The holding portion may include a fixing portion coupled to an inner surface of one of the first chamber or the door and configured to fix the clothing item, and a pressing portion rotatably coupled to the inner surface and configured to press the clothing item secured to the fixing unit. The pressing portion may be configured to rotate in a height direction of the door to press the clothing item. Therefore, a change in the position of the clothing item may be prevented.

The holding portion may further include a support unit disposed under the fixing portion and configured to support a surface of the clothing item, and the pressing portion may include a pressing body disposed above the support unit and configured to rotate toward the support unit and press the clothing item.

The pressing body may include a first body rotatably disposed above the base and configured to press the clothing item, and a second body rotatably disposed under the base and configured to press the clothing item or separate the first body from the clothing item.

The pressing body may further include a body through hole configured to allow the clothing item to communicate with the accommodation space.

The pressing portion may include a connection hinge configured to rotatably couple the first body and the second body to each other, and the connection hinge may couple the first body and the second body to each other, such that the second body is configured to rotate relative to the first body in a direction different from a direction in which the first body is configured to rotate.

The pressing portion may include a slide hinge configured to rotatably couple the first body and the second body to each other, and the slide hinge may include a withdrawing hinge coupled to the second body and configured to support the second body, and a receiving hinge coupled to the first body and configured to allow the withdrawing hinge to be inserted thereinto or be retracted therefrom and support the withdrawing hinge.

The receiving hinge may include a receiving body protruding from the first body toward the accommodation space, and a guide groove provided along a length direction of the receiving body. The withdrawing hinge may include a withdrawing body protruding from the second body toward the accommodation space and retractably received in the receiving body, and a stopper protruding from an outer surface of the withdrawing body and configured to move along the guide groove. The receiving body and the withdrawing body may be curved to allow the second body to rotate relative to the first body.

The holding portion may further include an engagement unit configured to couple the fixing portion with at least one of the door or the first chamber, and the engagement unit may be configured to control an installation height of the fixing unit.

The engagement unit may include an engagement body coupled to at least one of the door or the first chamber, and control ribs coupled to both side surfaces of the fixing portion in the engagement body and configured to move the fixing unit. The fixing portion may include a fixing body provided in front of the engagement body, and moving ribs provided on both sides of the fixing body and movably coupled with the control ribs. Further, a guide rail may be provided in one of the engagement body and the fixing body, to guide a movement direction of the fixing body, and a guide protrusion may be provided in the other of the engagement body and the fixing body, to be inserted in the guide rail and move in the guide rail.

The holding portion may further include a positioning unit configured to keep the fixing portion at a position in which the fixing portion is fixed to the engagement unit, and the positioning unit may include insertion portions protruding in a length direction of one of side surfaces of the control ribs or the moving ribs, and a plurality of fixing holes formed along a length direction of the other of the side surfaces of the control ribs or the moving ribs, to allow the insertion portions to be fixedly inserted thereinto.

The fixing portion may include a fixing body formed in the shape of a plate, and a fixing clip coupled to a front of the fixing body and configured to catch the clothing item thereon.

The fixing clip may include at least one grabbing groove defined by forming one surface of the fixing clip to be convex in at least one of an upward direction or a downward direction, to provide a space in which the clothing item is grabbed.

The fixing body may include a first fixing body coupled to the door or the first chamber, a second body disposed in front of the first fixing body, and a compression spring disposed between the first fixing body and the second fixing body and configured to push the second fixing body to the fixing clip and press a surface of the clothing item.

The first fixing body may include a guide rib configured to accommodate the second fixing body and guide a movement of the second fixing body.

The laundry treating apparatus may further include at least one support clip provided along a height direction of the first chamber or the door, and configured to fix the clothing item.

In another aspect of the present disclosure, a laundry treating apparatus may comprise a cabinet including an accommodation space configured to accommodate a clothing item therein, a supply portion configured to supply at least one of air or moisture into the accommodation space, a base disposed in the accommodation space, a pressing portion rotatable about a rotation shaft in a width direction of the base, in receding and approaching directions from and to the base, and a support unit rotatably disposed between the base and the pressing portion and configured to form a space in which the clothing item is fixed, the support unit including a mounting surface facing the pressing portion and configured to mount the clothing item to be pressed by the pressing portion thereon, and a pressing surface facing the base and configured to press the clothing item toward the base.

The support unit may include a support body disposed between the base and the pressing portion and including the mounting surface, the pressing surface, and a support surface formed on a top end of the support unit and configured to support the clothing item, and a pair of support-unit hinges configured to enable rotation of the support body about a rotation shaft extending along a width direction of the base in the receding and approaching directions from and to the base.

The support unit may include a support body disposed between the base and the pressing portion and including the mounting surface, the pressing surface, and a support surface formed on a top end of the support unit and configured to support the clothing item, and a pair of support unit hinges configured to rotate the support body about a rotation shaft extending along a height direction of the base in the receding and approaching directions from and to the base.

Each of the support-unit hinges may include a slit disposed along a height direction of the cabinet in the accommodation space, a first link including one end fixed to the support body and the other end inserted into the slit to make a reciprocating movement along the slit, and a second link including one end rotatably coupled with the first link or the support body, and the other end rotatably coupled in the accommodation space and configured to rotate in the receding and approaching directions from and to the base. When the support body rotates in the receding direction from the base, the second link may be configured to move the other end of the first link toward a bottom end of the slit, and when the support body rotates in the approaching direction to the base, the second link may be configured to move the other end of the first link toward a top end of the slit.

The laundry treating apparatus may further include a manipulator configured to generate a force to rotate the support body in the receding direction from the base, when the pressing portion rotates in the receding direction from the base. The manipulator may comprise a compression spring configured to provide the second link with the force to rotate the second link in the receding direction from the base.

The first link may include a first bar fixed to the support body, and a second bar may include one end coupled to the slit and the other end coupled to the first bar. When the support body rotates in the receding direction from the base, the second bar may form a space for inserting the clothing item therein between the support surface and the base.

The laundry treating apparatus may further include a guide configured to prevent a free end of the clothing item held on the support body from moving out of a space provided by the base.

The laundry treating apparatus may further include a support-body through hole configured to penetrate through the support body, and a pressing-unit through hole configured to penetrate through the pressing portion.

The laundry treating apparatus may further include a clothes fixing portion disposed on the mounting surface and configured to fix the clothing item. The clothes fixing portion may include a first fixing-unit body disposed along a width direction of the support body and fixed to the mounting surface, second and third fixing-unit bodies extending from respective ends of the first fixing-unit body along a height direction of the support bod, and a fourth fixing-unit body configured to couple a free end of the second fixing-unit body to a free end of the third fixing-unit body.

The pressing portion may include a pressing body disposed in the accommodation space and configured to rotate in the receding and approaching directions from and to the base, a pressing-unit recess formed on a surface of a space formed by the pressing body, facing the mounting surface, and configured to provide a space in which a sewing line of the clothing item may be accommodated. The pressing portion may also include a fixing-unit accommodation recess formed on the surface of the space formed by the pressing body, facing the mounting surface, and providing a space to accommodate the clothes fixing portion therein.

The laundry treating apparatus may further include a base recess formed on a surface of a space formed by the base, facing the pressing surface, and providing a space to accommodate a sewing line of the clothing item therein.

The base may comprise or be fixed to one of surfaces defining the accommodation space.

The laundry treating apparatus may further include an inlet configured to penetrate through a front surface of the cabinet and configured to allow the accommodation space to communicate with an outside of the first chamber. The base may be formed by or fixed to one surface of the door, facing the accommodation space.

The supply portion may include at least one of an air feeder configured to supply heated air into the accommodation space or a moisture feeder configured to supply steam or mist into the accommodation space.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings:

FIGS. 16A-16B illustrate an exemplary operation of the presser, according to the.

DETAILED DESCRIPTION OF THE INVENTION

Reference will now be made in detail to the embodiments of the present disclosure, examples of which are illustrated in the accompanying drawings. Wherever possible, the same reference numbers will be used throughout the drawings to refer to the same or like parts in spite of different embodiments. Unless context clearly dictates otherwise, singular forms include plural referents. A detailed description of a generally known function or structure of the present disclosure will be avoided lest it should obscure the subject matter of the present disclosure. It is to be understood that the attached drawings are provided to serve the sole purpose of better aid in understanding the embodiments of the present disclosure, not intended to limit the spirit of the present disclosure.

FIGS. 2 to 9 illustrate an embodiment of a laundry treating apparatus according to the present disclosure.

Figure 1:
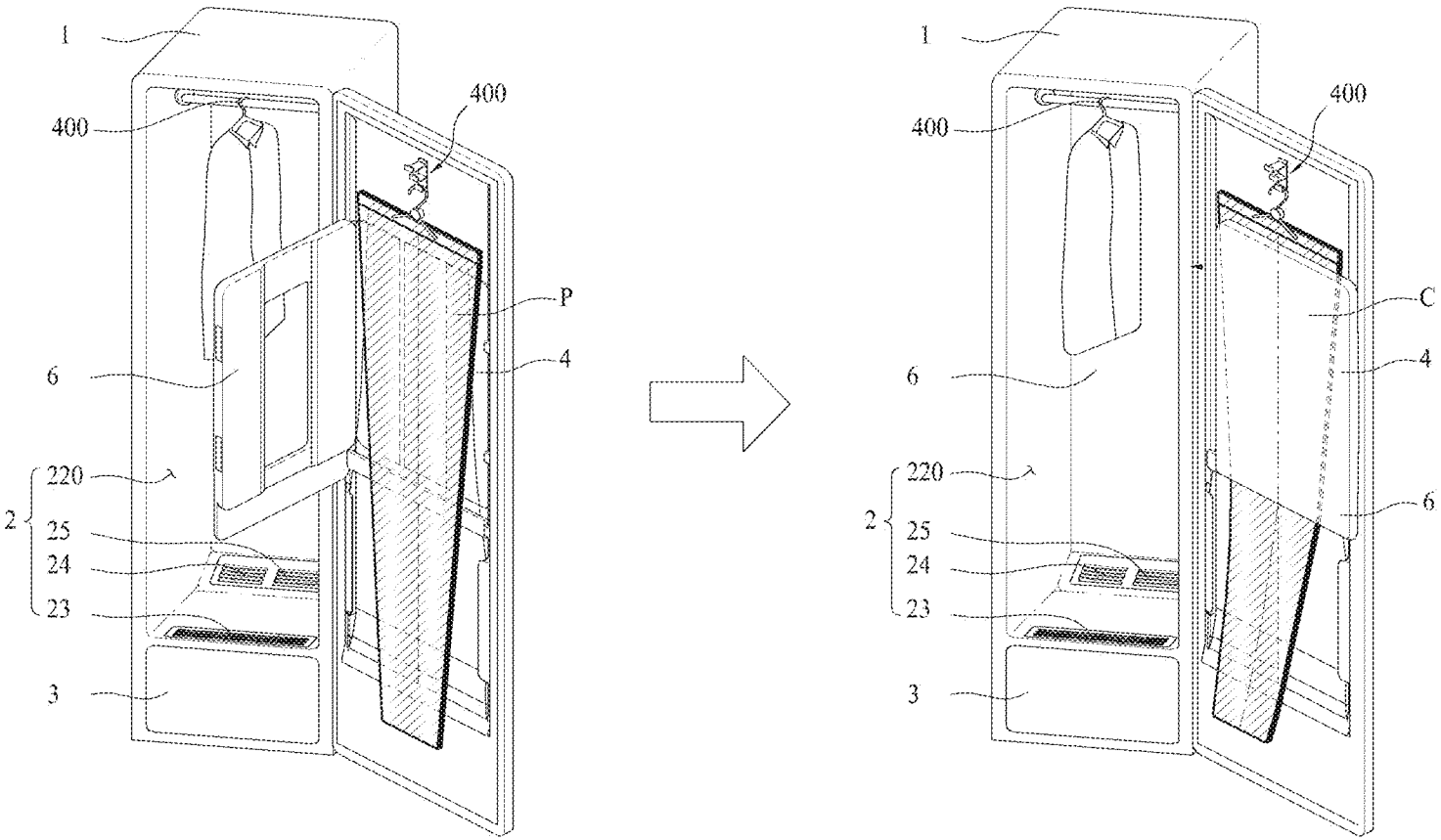
FIG. 1 illustrates the configuration of a conventional clothes treating apparatus.
Figure 2B:
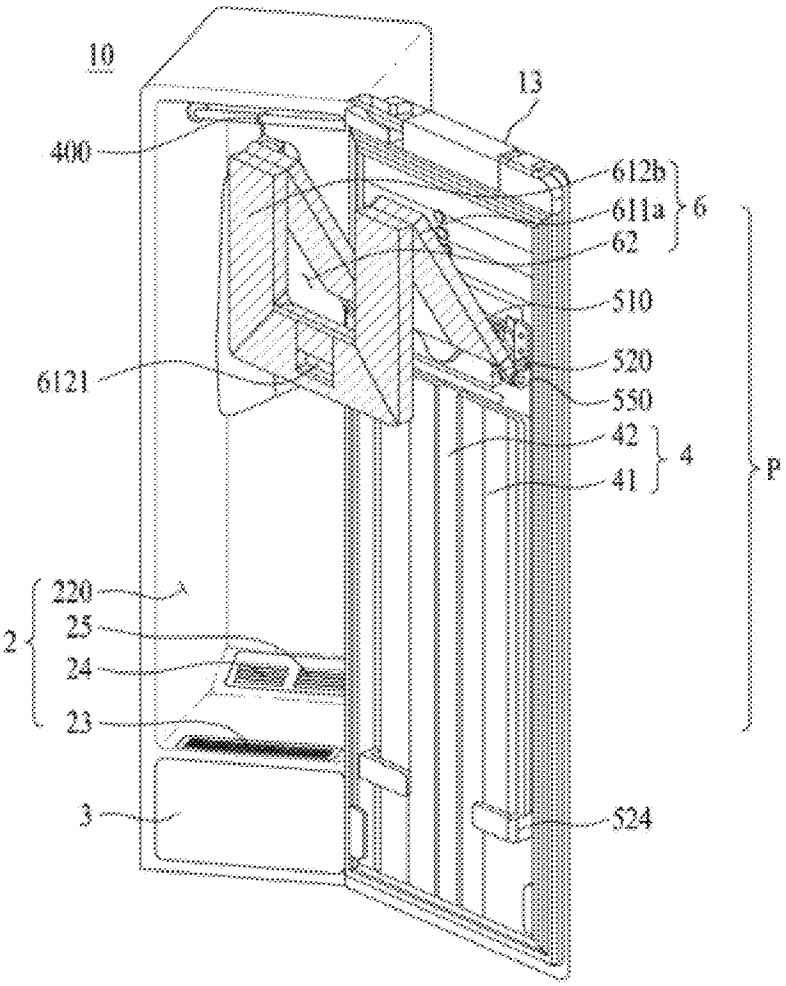
FIGS. 2A-2B illustrate the structure of an exemplary laundry treating apparatus, according to the embodiments of the present disclosure.
Figure 2A:
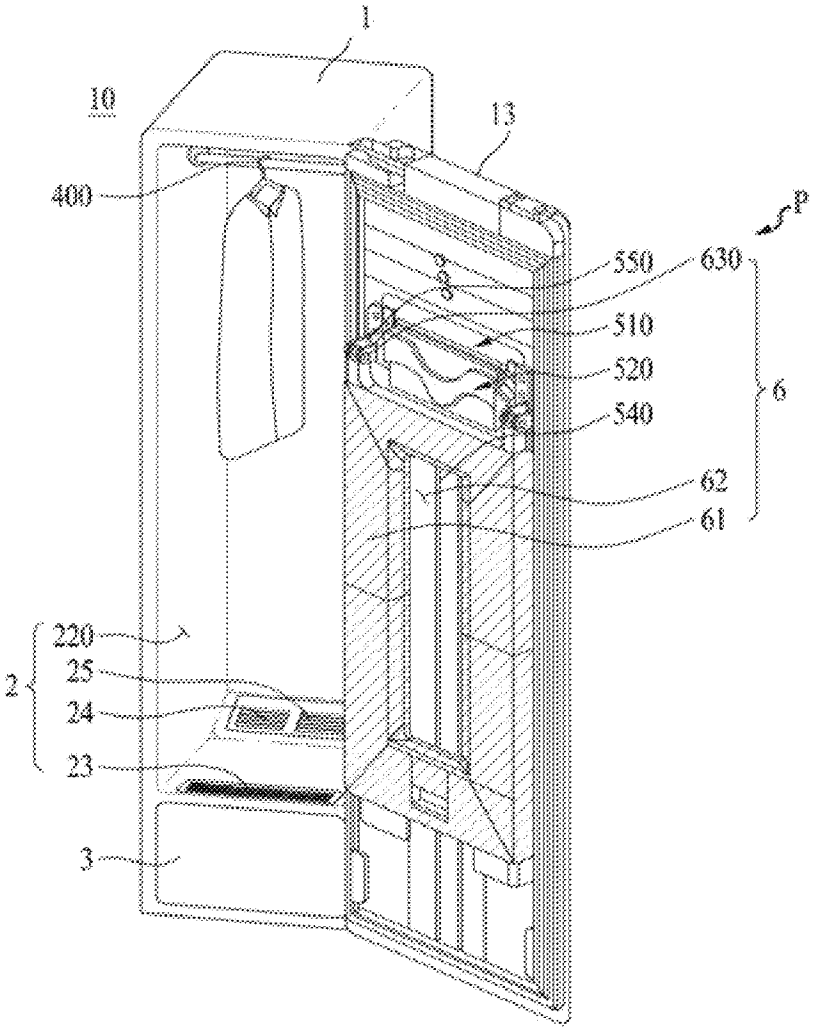

FIGS. 2A-2B illustrate the structure of an exemplary laundry treating apparatus 10.

Figure 12:
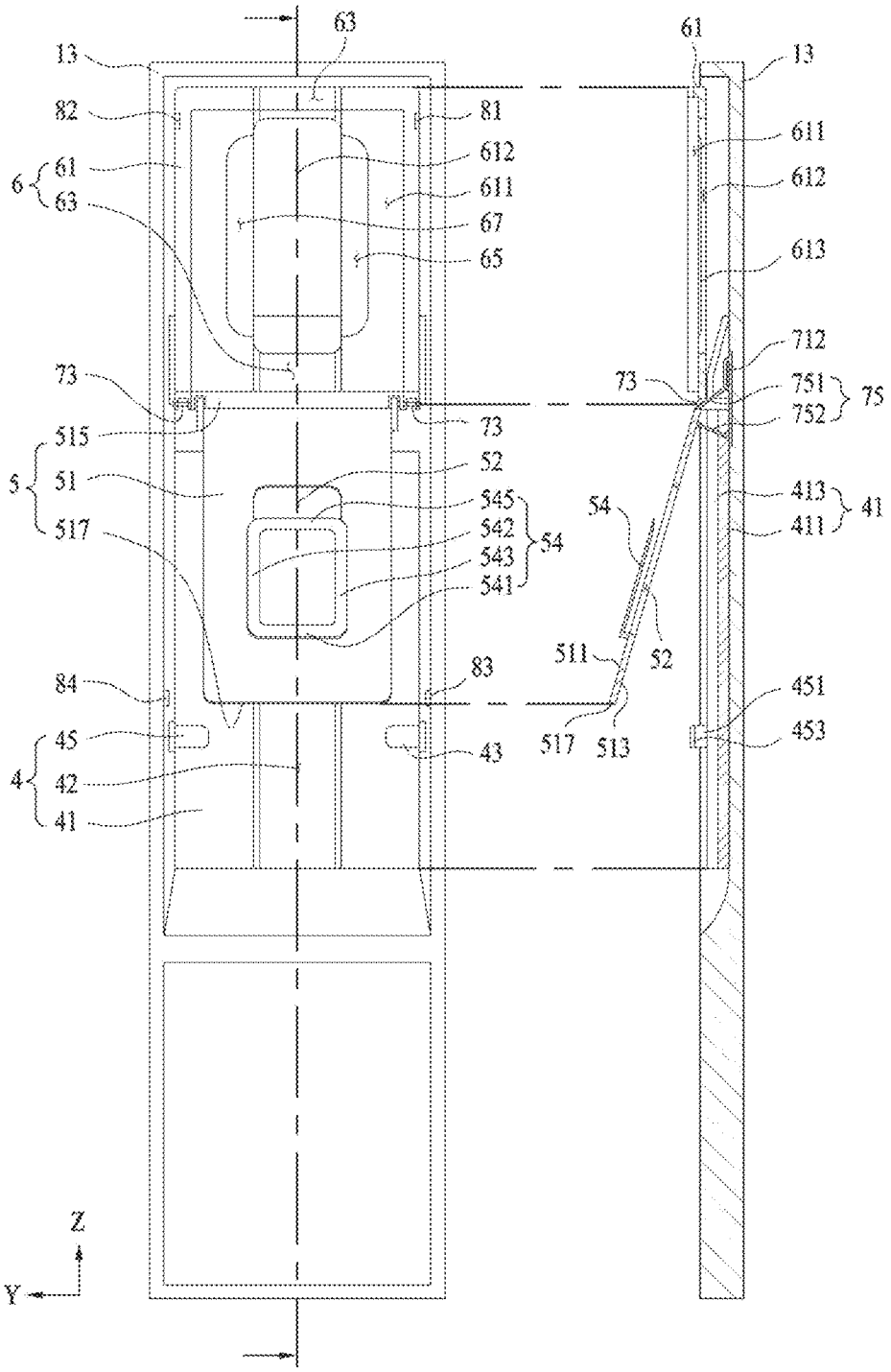
FIG. 12 illustrates an exemplary presser, according to the embodiments of the present disclosure.

Referring to FIG. 2A, the laundry treating apparatus 10 according to the present disclosure may comprise a cabinet 1 including an inlet on a front side thereof, a door 13 rotatably coupled to the cabinet 1 and configured to open and close the inlet, a first chamber 2 provided in the cabinet to provide an accommodation space 220 configured to accommodate a clothing item C therein, supply portions, such as air feeder 31 and moisture feeder 34 in FIG. 12, in communication with the first chamber 2 to feed at least one of air or moisture into the accommodation space 220, and a holding portion 400 provided in at least one of the first chamber 2 or the door 13 to hold or immobilize the clothing item C in the accommodation space 220.

The cabinet 1 may form the exterior of the laundry treating apparatus 10 and may be more high than wide. Accordingly, the clothing item C, which may be more long than wide, like bottoms, may be placed in the accommodation space 220 without being folded, thereby avoiding wrinkles.

The cabinet 1 may be formed of a metallic material. In some embodiments, the cabinet 1 may be formed of resin, such as reinforced plastic, as long as the strength of the cabinet 1 can be maintained.

The first chamber 2 may be located inside the cabinet 1 and may define the accommodation space 220. The first chamber 2 may be formed of a material which resists deformation or chemical reaction against a foreign material from the clothing item C, or hot air or moisture fed by the supply portions, such as air feeder 31 and moisture feeder 34. For example, the first chamber 2 may be formed of styrene resin, such as acrylonitrile-butadiene-styrene (ABS) or acrylonitrile-styrene-acrylate (ASA).

The first chamber 2 may communicate with the supply portions, such as air feeder 31 and moisture feeder 34, through one surface thereof, and may receive hot air or moisture from the supply portions, or may discharge air to the supply portions. For this purpose, the first chamber 2 may include a plurality of through holes 23, 24 and 25 in communication with the supply portions, such as air feeder 31 and moisture feeder 34.

The cabinet 1 may further comprise supply portions, such as air feeder 31 and moisture feeder 34, that are separate from the accommodation space 220. By way of example, the air feeder 31 and moisture feeder 34 may be disposed under the accommodation space 220 in order to supply heated air or steam having a low density relative to air.

That is, if air and moisture supplied into the accommodation space 220 by the supply portions, such as air feeder 31 and moisture feeder 34, are heated air and steam, respectively, the supply portions may only need to be located under the accommodation space 220 to uniformly supply heated air or steam into the accommodation space 220 without an additional blower.

The door 13 may be rotatably coupled to the cabinet 1 and configured to open and close the inlet. The door 13 may shield the front of the supply portions 31 and 34 as well as the first chamber 2. Therefore, leakage of hot air or moisture supplied into the accommodation space 220 to the outside may be prevented, and transfer of heat emitted from the supply portions to the outside may be blocked.

Since the door 13 may be configured to open and close the front of the first chamber 2, an inner circumferential surface of the first chamber 2 and an inner surface of the door 13 may form an outer circumferential surface of the accommodation surface 220.

The holding portion 400 may include a hanger support 27 configured to hold the clothing item C in the accommodation space 220 inside the first chamber 2, and a presser P configured to hold the clothing item Con an inner surface of the first chamber 2 or the inner surface of the door 13.

That is, the hanger support 27 may be provided in the form of a hanger or a bar inside the first chamber 2 so that the clothing item C may be exposed uniformly in the accommodation space 220. The presser P may be provided to attach the clothing item C onto the inner circumferential surface (surface) of the first chamber 2 or the inner surface of the door 13, and keep the clothing item C immobilized therewith.

The hanger support 27 may be disposed on a ceiling surface of the first chamber 2 or in an upper part of a side surface of the first chamber 2 such that the clothing item C may be hung fully spread without being folded in the accommodation space 220.

As such, the hanger support 27 may hold the clothing item C unfolded by self-weight in the accommodation space 220 so that the clothing item C may be exposed uniformly to air or moisture supplied from the supply portions, such as air feeder 31 and moisture feeder 34.

The presser P may keep the clothing item C attached to the inner circumferential surface of the accommodation space 220. Therefore, the presser P may actively remove wrinkles out of the clothing item C or form a crease on the clothing item C.

Specifically, the presser P may include a fixing portion 520 coupled to the inner surface of at least one of the first chamber 220 or the door 13, to fix the clothing item C, and a pressing portion 6 rotatably coupled to at least one of the first chamber 2 or the door 13, to press the clothing item fixed by the fixing portion 520.

The pressing portion 6 may be rotatably coupled to the inner surface having the fixing portion 520 thereon, and may be pressed or attached onto the inner surface.

As such, the pressing portion 6 may press the inner surface, apart therefrom, to thereby press the clothing item C held on the fixing portion 520.

While the presser P is disposed on the inner surface of the door 13 in FIG. 2, as long as the presser P can press the clothing item C, the presser P may be provided on the inner surface of the first chamber 2. Further, a plurality of pressers P may be provided on the inner surface of the door 13 or the first chamber 2. The following description is given with the appreciation that the presser P is provided on the door 13, by way of example. The description is intended only for the purpose of describing embodiments, not excluding the case in which the presser P is provided on a side surface of the first chamber 2.

Referring to FIGS. 2A and 2B, the pressing portion 6 may be rotatably provided in a height direction of the door 13 or the cabinet 1.

That is, the pressing portion 6 may press the clothing item C from top to bottom or from bottom to top, not from one side surface to the other side surface of the clothing item C.

To press the clothing item C by self-weight, the pressing portion 6 may press the clothing item C held on the fixing portion 520 from top to bottom.

Once the clothing item C is held on the fixing portion 520, tensile force may be applied downward to the clothing item C by self-weight so that the clothing item C may be extended downward. If the pressing portion 6 presses the clothing item C sideways or in a width direction, the direction in which the self-weight of the clothing item C is directed may be different from the direction in which the pressing portion 6 presses the clothing item C, thereby resulting in deformation or displacement of the clothing item C.

Therefore, the clothing item C may be wrinkled by the pressing portion 6, or an unintended area of the clothing item C may be pressed and thus creased.

In contrast, if the pressing portion 6 presses the clothing item C from top to bottom, the pressed direction of the clothing item C may be identical to the self-weight direction of the clothing item C, thereby preventing deformation or displacement of the clothing item C.

Accordingly, when the clothing C is mounted on the fixing portion 520, the laundry treating apparatus 10 of the present disclosure may prevent the pressing portion 6 from generating wrinkles or a crease on an unintended area of the clothing item C because the clothing item C can be kept in place even though the clothing item C is pressed.

Further, since the pressing portion 6 may be configured to rotate in a height direction, the pressing portion 6 may be extended along the height direction of the inner surface of the door 13 or the side surface of the first chamber 2. Therefore, the pressing portion 6 may press a wider area than when the pressing portion 6 is rotated in the width direction.

By way of example, because the cabinet 1 may have a larger height-to-width ratio, the above effect may be increased. because the entire area of bottoms as well as tops is pressed by the pressing portion, there may be no need for ironing the bottoms and tops.

The presser P may further include a base 4 configured to press a surface of the clothing item C, which does not contact the pressing portion 6, when the pressing portion 6 presses the clothing item C.

The base 4 may be disposed under the fixing portion 520 to support or contact the surface of the clothing item C.

By way of example, the base 4 may include base bodies 41 formed in the shape of plates, for pressing the clothing item C, when the pressing portion 6 presses. As such, the base bodies 41 may apply a reaction force to the pressing force of the pressing portion 6 to the clothing item C, thereby pressing the clothing item C.

The base 4 may further include a base recess 42 between the base bodies 41, to provide a space in which the clothing item C is not pressed. The base recess 42 may bring the base bodies 41 and the pressing portion 6 into tighter contact by providing elasticity of the base bodies 41. Further, if the clothing item C comprises bottoms, the base recess 42 may prevent formation of an unnecessary crease which might otherwise be formed due to pressing of a sewing line of the clothing item C.

The pressing portion 6 may include a pressing body 61 rotatable over the base 4, to press the clothing item C.

The pressing body 61 may be formed in the shape of a plate with a predetermined thickness, to press the base bodies 41.

Further, the pressing portion 6 may further include a pressing-unit through hole 62 which may penetrate through the pressing body 61, to make the clothing item C communicate with the accommodation space 220.

The pressing-unit through hole 62 may be formed along the length direction of the pressing body 61 or along the base recess 42, thereby preventing formation of an unnecessary crease on the clothing item C, which might otherwise be caused by a sewing line of the clothing item C. Further, even if the pressing portion 6 presses the clothing item C by the pressing body 61, the pressing portion 6 may induce continuous supply of air or steam to the clothing item C.

The pressing portion 6 may include hinge units 7 which may be extended from an upper part or lower part of the pressing body 61 and rotatably coupled to the door 13.

The hinge units 7 may be rotatably coupled to rotation shafts 550 provided at both sides of the fixing portion 520 such that the pressing body 61 may rotate along the height direction over the door 13.

The rotation shafts 550 may be arranged along the width direction of the cabinet 1 such that the pressing body 61 may rotate in the height direction of the cabinet 1 or in a direction perpendicular to the ground.

The rotation shafts 550 may be integrated into the first chamber 2 and the door 13.

Referring to FIG. 2B, the pressing portion 6 in the laundry treating apparatus 10 of the present disclosure may include a first body 611*a* rotatably provided on the door 13, to press the clothing item C, and a second body 612*a* rotatably coupled to the first body 611*a* thereunder, to press the clothing item C.

The second body 612*a* may rotate with respect to the first body 611*a*, and thus the first body 611*a* and the second body 612*a* may be folded to each other.

In this manner, even if the pressing body 61 is extended along the height direction of the door 13, the first body 611*a* and the second body 612*a* may be folded to each other, thereby reducing the rotation radius of the pressing body 61. Therefore, a user may easily rotate the pressing body 61 which may be relatively long.

To facilitate rotation of the pressing body 61, the second body 612*a* may be provided with a handle 6121.

Figure 3A:
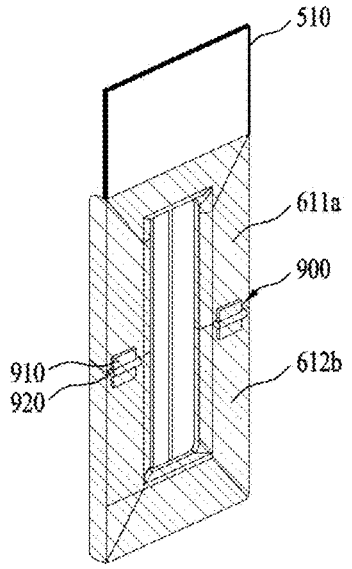
FIGS. 3A-3B illustrate an exemplary pressing portion configured to rotate to press a clothing item, according to the embodiments of the present disclosure.
Figure 3B:
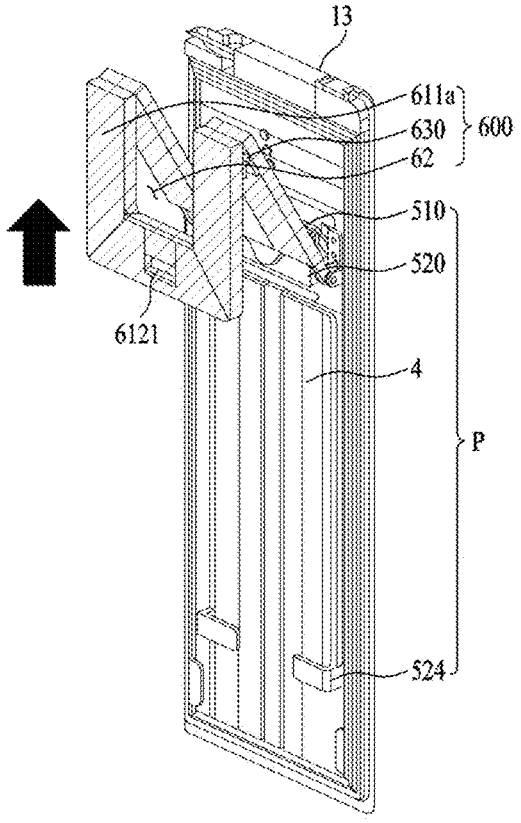

FIGS. 3A-3B illustrate a mechanism in which an exemplary first body and an exemplary second body may be rotated.

FIG. 3A illustrates the pressing portion 6 seen from a direction from the door 13 toward the accommodation space 220, and FIG. 3B illustrates a mechanism in which the pressing body 61 may be configured to rotate to be separated from the base 4.

Referring to FIG. 3A, the pressing portion 6 may include connection hinges 630 which may enable the first body 611*a* and the second body 612*a* to be rotatably coupled to each other.

The connection hinges 630 may couple the first body 611*a* and the second body 612*a* to each other such that the second body 612*a* is configured to rotate from the first body 611*a* in a direction different from a direction in which the first body 611*a* is configured to rotate from the door 13.

In some embodiments, each of the connection hinges 630 may include attached plates 631 attached to the first and second bodies 611*a* and 612*a*, respectively, and rotation portions 632 which may be configured to rotatably couple the attached plates 631 to each other.

The rotation portions 632 may prevent contact between the attached plates 631.

Referring to FIG. 3B, when the user grabs the handle 6121 and lifts the pressing body 61, the first body 611*a* and the second body 612*a* may be folded to each other at a predetermined angle, apart from the base 4.

Since the first body 611*a* and the second body 612*a* may be configured to rotate in opposite directions, even if the first body 611*a* recedes from the base 4 to a position above the base 4, a bottom end of the second body 612*a* or the handle 6121 may be positioned below the first body 611*a*.

Consequently, even if the first body 611*a* is sufficiently lifted up, apart from the base 4, the second body 612*a* may be positioned at a relatively low position. In other words, even if the second body 612*a* is raised to a predetermined height, the first body 611*a* may be raised much higher than the second body 612*a*.

That is, even a relatively short user may hang or remove the clothing item C on or from the fixing portion 520 by fully rotating the pressing body 61.

Further, the first body 611*a*, the second body 612*a*, and the base 4 may form a wider area than when the second body 612*a* and the first body 611*a* rotate in the same direction. In this manner, the user may easily hang or remove the clothing item C on or from the fixing portion 520.

Figure 4A:
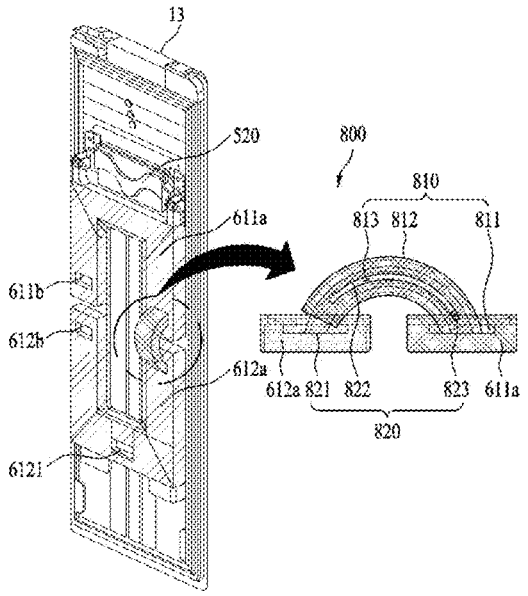
FIGS. 4A-4B illustrate an exemplary first body and an exemplary second body configured to rotate, according to the embodiments of the present disclosure.
Figure 4B:
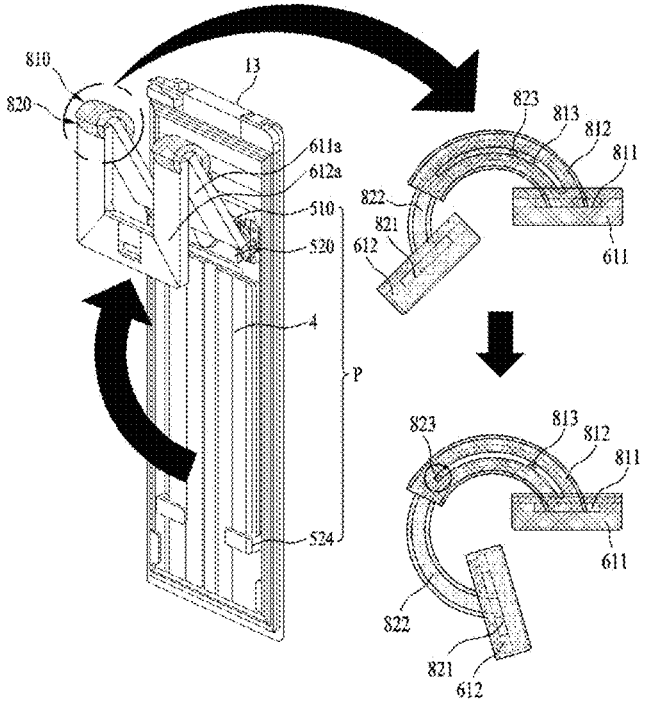

FIGS. 4A-4B illustrate another exemplary mechanism in which the first body 611*a* and the second body 612*a* may be rotated.

Referring to FIG. 4A, the pressing portion 6 may include slide hinges 800 configured to couple the first and second bodies 611*a* and 612*a* rotatably to each other.

The slide hinges 800 may also couple the first body 611*a* to the second body 612*a* such that the second body 612*a* can be configured to rotate from the first body 611*a* in a direction different from a direction in which the first body 611*a* is configured to rotate from the door 13.

Each of the slide hinges 800 may include a withdrawing hinge 820 coupled to the second body 612*a*, to support the second body 612*a*, and a receiving hinge 810 engaged with the first body 611*a*, to allow the withdrawing hinge 820 to withdraw therefrom or be inserted thereinto, and support the withdrawing hinge 820.

The receiving hinge 810 may include a receiving body 812 protruding from the first body 611*a* toward the accommodation space 220, and a guide groove 813 formed along the length direction of the receiving body 812. A hollow hole may be formed inside the receiving body 812, to receive the withdrawing hinge 820 therein.

A withdrawing body 822 and the receiving body 812 may guide a rotation trace of the first body 611*a* and the second body 612*a*. Therefore, the withdrawing body 822 and the receiving body 812 may be curved in correspondence with the rotation trace of the first body 611*a* and the second body 612*a*.

Specifically, when the first body 611*a* and the second body 612*a* are even with each other, a free end of the receiving body 812 may be brought into contact with the second body 612*a*. Therefore, overrotation of the second body 612*a* may be prevented.

The withdrawing hinge 820 may include the withdrawing body 822 protruding from the second body 612*a* toward the accommodation space 220 and coupled to the receiving body 812 such that the withdrawing body 822 may be received in and removed from the receiving body. The withdrawing hinge 820 may also include a stopper 823 protruding on an outer surface of the withdrawing body 822, to move along the guide groove 813.

Thus, as the stopper 823 moves from one end of the guide groove 813 to the other end of the guide groove 813, the withdrawing hinge 820 may withdraw from or be inserted into the receiving hinge 810. Further, since the stopper 823 is engaged with the guide groove 813, deviation of the withdrawing hinge 820 from the receiving hinge 810 may be prevented.

Further, the guide groove 813 may be configured to prevent full overlap between the first body 611*a* and the second body 612*a*.

The receiving hinge 810 and the withdrawing hinge 820 may be incorporated in the pressing body 61. In other embodiments, the receiving hinge 810 may be separate from the pressing body 61.

The first body 611*a* may include first hinge through holes 611*b* penetrating through one surface thereof, to receive the receiving hinges 810 therein, and each of the receiving hinges 810 may further include a fixing rib 811 contacting the inner surface of the first body 611*a*, to support the first body 611*a*. The receiving body 812 may extend from the fixing rib 811 to the outside of the first body 611*a* through a first hinge through hole 611*b*.

The second body 612*a* may include second hinge through holes 612*b* penetrating through one surface thereof, to receive the receiving hinges 820 therein, and each of the receiving hinges 820 may further include a support rib 812 contacting the inner surface of the second body 612*a*, to support the second body 612*a*. The withdrawing body 822 may extend from the support rib 812 to the outside of the second body 612*a* through a second hinge through hole 612*b*.

Referring to FIG. 4A, when the first body 611*a* and the second body 612*a* are even with each other, as is the case, for example, with the pressing portion 6 pressing the clothing item C held on the base 4, the withdrawing hinges 820 may be inserted into and received in the receiving hinges 810. The stoppers 823 may be positioned at one ends of the guide grooves 813.

Referring to FIG. 4B, when the pressing portion 6 is separated from the base 4, the withdrawing hinges 820 may start to rotate from the first body 611*a*, thereby withdrawing from the receiving hinges 810. The stoppers 823 may move along the guide grooves 813.

When the pressing portion 6 is distanced farther from the base 4, the withdrawing hinges 820 may withdraw from the receiving hinges 810 as far as possible, and the stoppers 823 may be positioned at distal ends of the guide grooves 813. Until then, the second body 612*a* may be configured to rotate from the first body 611*a*.

Thereafter, the stoppers 823 may be fixed at the distal ends of the guide grooves 813, thereby preventing full withdrawal of the withdrawing hinges 820 from the receiving hinges 810. The second body 612*a* may then stop rotating from the first body 611*a* and raise up the first body 611*a*.

When the pressing portion 6 rotates toward the base 4 again, the above operation may be performed in a reverse order.

Figure 5:
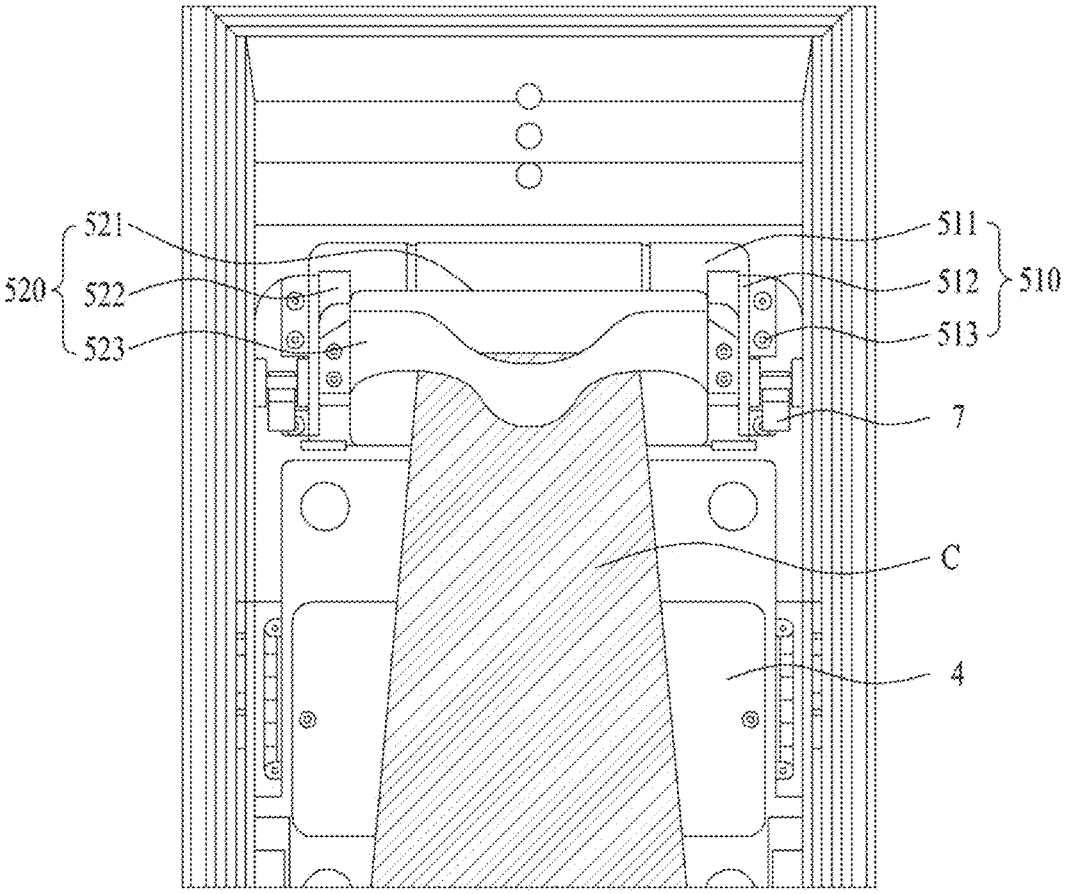
FIG. 5 illustrates the structure of an exemplary fixing portion configured to fix a clothing item, according to the embodiments of the present disclosure.

FIG. 5 illustrates a mechanism in which the clothing item C is placed and immobilized in the laundry treating apparatus of the present disclosure.

The presser P may further include an engagement unit 510 to engage the fixing portion 520 with at least one of the door 13 or the first chamber 200.

If the presser P is provided on the door 13, the engagement unit 510 may have one surface engaged with the inner surface of the door 13 and the other surface engaged with the fixing portion 520. Therefore, the fixing portion 520 may be firmly engaged with the door 13, thereby stably holding a heavy clothing item C.

The engagement unit 510 may include an engagement body 511 attached on the inner surface of the door 13, control ribs 512 engaged with both side surfaces of the fixing portion 520, and engagement ribs 513 extended from both sides of the control ribs 512 and engaged with the inner surface of the door 13. The engagement ribs 513 may be firmly engaged with the inner surface of the door 13 by fastening members, such as bolts or nuts, thereby supporting the engagement body 510 and the fixing portion 520.

Rotation shafts, such as rotation shafts 550 in FIGS. 7A-7D, may extend from the engagement ribs 513. As illustrated, the rotation shafts 550 may extend under the engagement ribs 513. The rotation shafts 550 may be disposed close to the engagement ribs 513 and thus may secure durability and strength.

The rotation shafts 550 may be formed into protruding rings, and the hinge units 7 extended from the pressing body 61 may be formed into hooks caught in the rotation shafts 550.

The fixing portion 520 may include a fixing body 521 in front of the engagement body 511, moving ribs 522 provided at both sides of the fixing body 521 and engaged with the control ribs 512, and a fixing clip 523 in front of the fixing body 521, into which the clothing item C may fixedly be inserted.

The fixing clip 523 may extend from one side to the other side of the fixing body 521 which may be formed into a plate. Therefore, the fixing clip 523 may secure both strength and durability in holding the clothing item C.

The clothing item C may be fixedly inserted between the fixing clip 523 and the fixing body 521, with a surface thereof attached to and supported by the base 4.

FIGS. 6A-6D illustrate an exemplary process of fixing and pressing the clothing item C by the presser P.

Figure 6A:
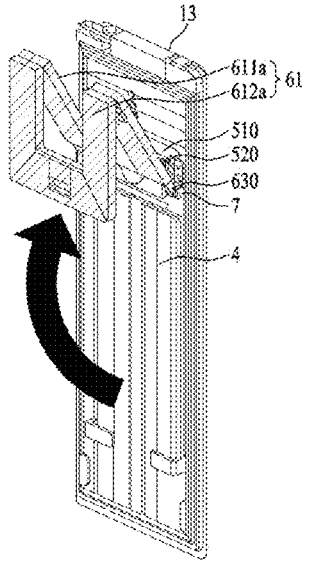
FIGS. 6A-6D illustrate an exemplary mechanism in which a clothing item is pressed in the laundry treating apparatus, according to the embodiments of the present disclosure.

Referring to FIG. 6A, the pressing body 61 may be configured to rotate upon the hinge units 7 and may be separated from the base 4. Since the second body 612*a* is configured to rotate in a direction opposite to the rotation of the first body 611*a*, the second body 612*a* may be positioned under the bottom end of the first body 611*a*.

Figure 6B:
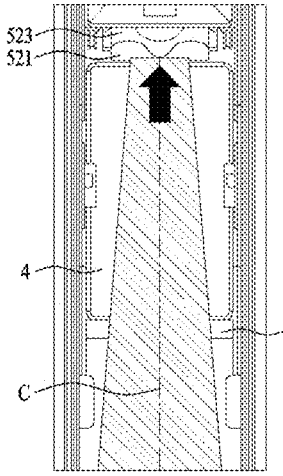

Referring to FIG. 6B, the user may insert and fix the clothing item C in the fixing clip 523. At the same time, the clothing item C may be brought into contact with and hence supported by the base 4.

Figure 6C:
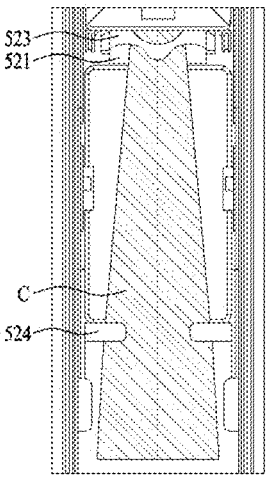

Referring to FIG. 6C, the clothing item C may be fixed by at least one support clip 524 provided along the length direction of the first chamber 2 or the door 13.

That is, the clothing item C may be hung with one end thereof fixed to the fixing clip 523 and the side surfaces thereof fixed to the at least one support clip 524.

Figure 6D:
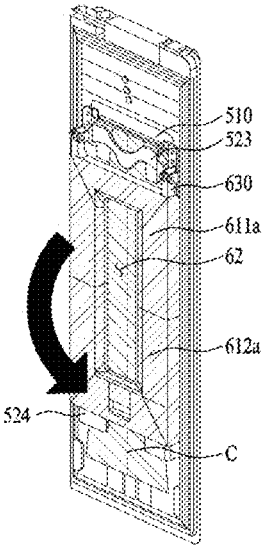

Referring to FIG. 6D, the user may press the clothing item C by rotating the pressing portion 6 toward the base 4. Even if the external force of the user is released from the pressing portion 6, the pressing portion 6 may continuously press the clothing item C by self-weight.

In this state, the user may close the door 13 and operate the laundry treating apparatus 10, thus supplying hot air or moisture to the clothing item C. Therefore, wrinkles may be removed out of an area of the clothing item C pressed by the pressing portion 6 and crease may be formed on the side ends of the clothing item C.

The clothing item C may be removed from the laundry treating apparatus 10 by performing the above process in a reverse order.

FIGS. 7A-7D illustrate an exemplary embodiment of controlling an installation height of the fixing portion 520.

The fixing portion 520 may be placed at a variable position above or under the engagement unit 510. The position of the fixing portion 520 may be controlled according to the length of the clothing item C, or may be controlled to select an area to be pressed by the pressing portion 6.

Figure 7A:
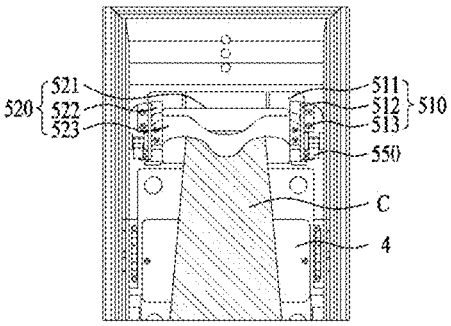
FIGS. 7A-7D illustrate an exemplary mechanism in which a hanging height of a clothing item is controlled in the laundry treating apparatus, according to the embodiments of the present disclosure.
Figure 7B:
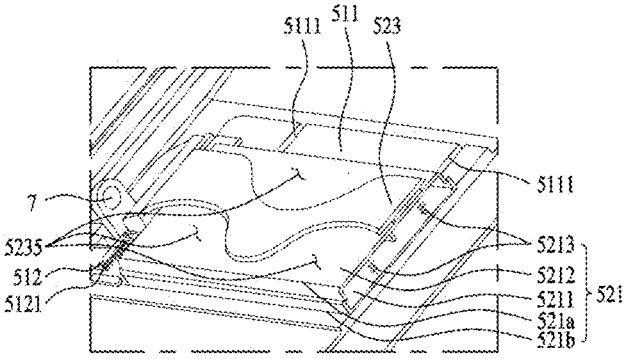

Referring to FIGS. 7A and 7B, the fixing body 520 may be positioned under the engagement unit 510.

The moving ribs 522 may be engaged with the control ribs 512 to make an upward or downward sliding movement on the control ribs 512.

In some embodiments, each of the control ribs 512 may include a slide groove 5121 formed on one surface thereof facing a moving rib 520, and a side surface of the moving rib 520 may be inserted into the slide groove 5121. Therefore, the moving rib 520 may move along the slide groove 5121.

One of the engagement body 511 and the fixing body 521 may include guide rails 5111 to guide a movement direction of the fixing body 521, and the other of the engagement body 511 and the fixing body 521 may include guide protrusions 5211 which are inserted into and move along the guide rails 5111.

For example, the guide protrusions 5211 may protrude from the rear surface of the fixing body 521, and the guide rails 5111 may be formed on the front surface of the fixing body 511, at positions corresponding to the guide protrusions 5211.

A plurality of guide protrusions 5211 and a plurality of guide rails 5111 may be provided spaced apart from each other by a predetermined distance.

Therefore, even if external force is not applied uniformly to the fixing portion 520, upward or downward movement of only the moving rib 522 and the control rib 512 at one side may be prevented.

Figure 7C:
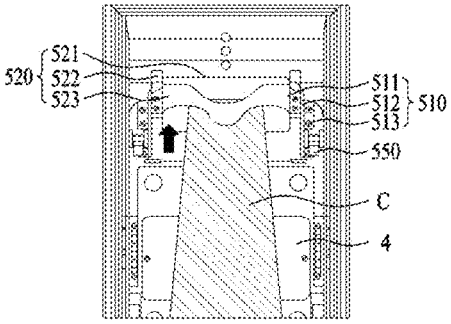
Figure 7D:
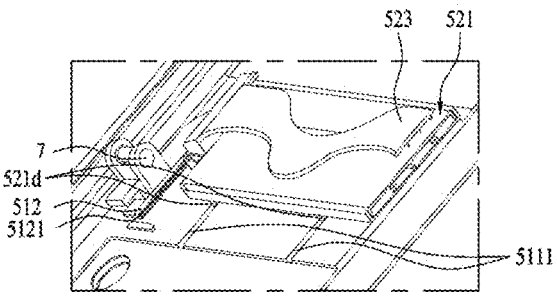

Referring to FIGS. 7C and 7D, the user may move the fixing portion 520 to a position above the engagement unit 510 by applying upward external force to the fixing portion 520.

In some embodiments, the moving ribs 522 may move up along the slide grooves 5121 of the control ribs 512, and the guide protrusions 5211 may move up along the guide rails 5111.

The user may control a height at which the clothing item C is hung on the presser P by controlling the position of the fixing portion 520 according to the length of the clothing item C.

Figure 8:
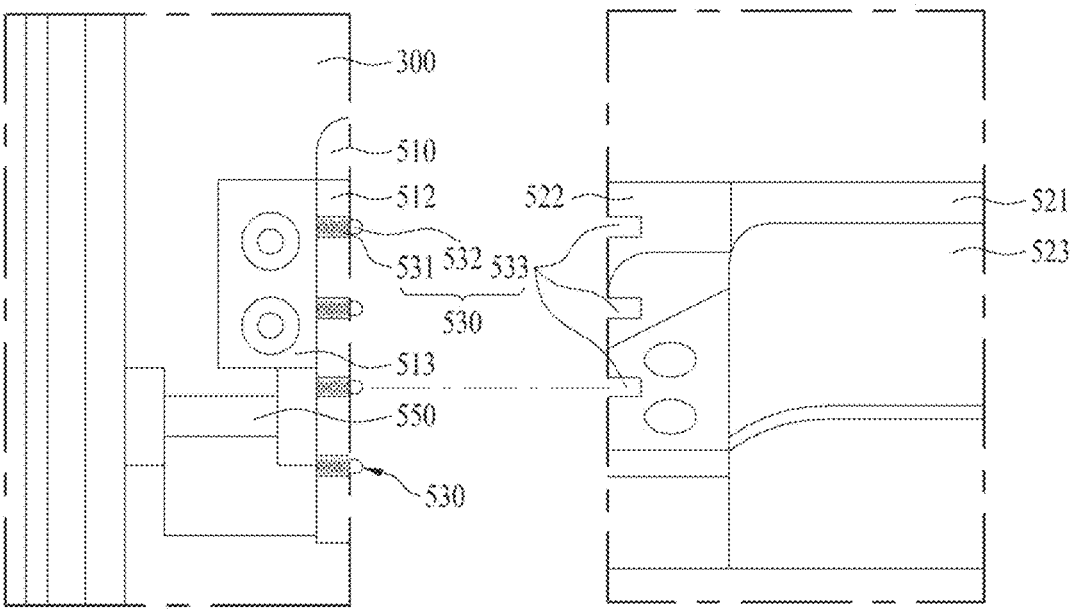
FIG. 8 illustrates an exemplary mechanism in which a hanging height of a clothing item is kept unchanged in the laundry treating apparatus, according to the embodiments of the present disclosure.

FIG. 8 illustrates an exemplary mechanism in which the height of the fixing portion 520 is controlled and maintained.

Even if the installation position of the fixing portion 520 on the engagement unit 510 is controllable, the height control of the fixing portion 520 may be meaningful only when the position of the fixing portion 520 is fixed.

For this purpose, the presser P of the present disclosure may further include a positioning unit 530, to maintain a position in which the fixing portion 520 is fixed to the engagement unit 510.

The positioning unit 530 may include insertion portions 532 protruding from one of both side surfaces of a control rib 512 or a moving rib 522 along the length of the control rib 512 or the moving rib 522, and a plurality of fixing holes 533 formed along the length direction of the other side surface of the control rib 512 or the moving rib 522, into which the insertion portions 532 may be fixedly inserted.

While the insertion portions 532 and the fixing holes 533 are provided on the control rib 512 and the moving rib 522, respectively, in the drawing, the opposite case is also possible. For example, the insertion portions 532 and the fixing holes 533 may be provided on the moving rib 522 and the control rib 512, respectively.

As the insertion portions 532 are inserted into changed fixing holes 533, the height of the fixing portion 520 may be controlled and fixed.

To allow the fixing portion 520 to be fixed at a position and move easily, the insertion portions 532 may be tapered toward free ends thereof so that the diameters of sections of the insertion portions 532 become smaller toward the free ends.

Further, springs 531 may further be provided to control the protruding lengths of the insertion portions 530, and the control rib 512 may include holes into which the insertion portions 530 may be inserted.

As such, when the insertion portions 530 are attached on the surface of the moving rib 522 or the control rib 512, the insertion portions 530 may move toward the springs 531. When the insertion portions 530 face the fixing holes 533, the insertion portions 530 may fit into the fixing holes 533 by elastic force of the springs 531, thereby fixing the fixing portion 520.

A plurality of insertion portions 530 may be provided apart from each other by a distance corresponding to the distance between the fixing holes 533. Therefore, as the insertion portions 532 are inserted into changed fixing holes 533, the position of the fixing portion 530 may be fixed.

Figure 9A:
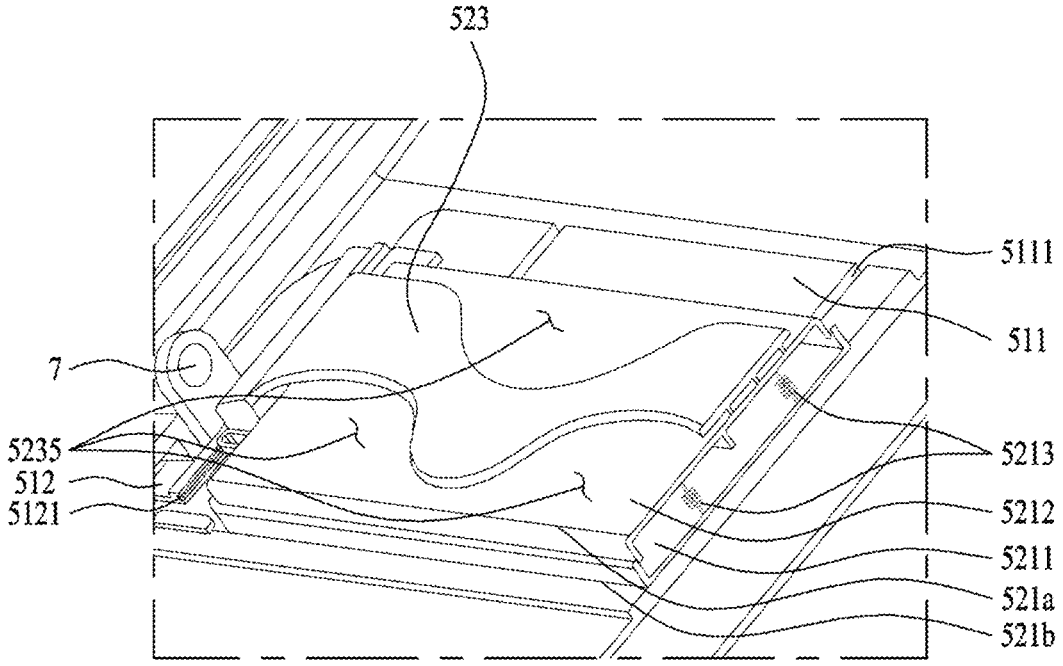
FIGS. 9A-9B illustrate an exemplary mechanism in which a clothing item is immobilized in the laundry treating apparatus, according to the embodiments of the present disclosure.
Figure 9B:
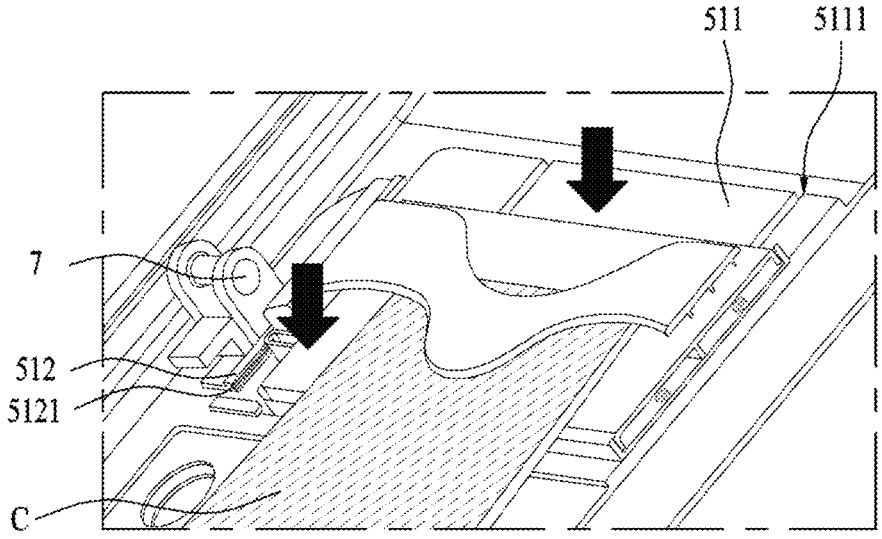

FIGS. 9A-9B illustrate an exemplary mechanism of facilitating placement and removal of the clothing item C, while fixing and immobilizing the clothing item C on the fixing clip 523.

Referring to FIG. 9A, one surface of the fixing clip 523 may be convex in at least one direction of upward or downward, thereby defining at least one grabbing groove 5235 for providing a space in which the clothing item C may be grabbed.

The at least one grabbing groove 5235 may be formed in at least one of an area above or an area below the fixing clip 523.

Thus, the user may fix the clothing item C to the fixing clip 523 by pushing up the clothing item C to a grabbing groove 5235 under the fixing clip 523 and pulling up the exposed clothing item C to a grabbing groove 5235 above the fixing clip 523. Therefore, even if the fixing clip 523 is relatively thick, the clothing item C may be held on the fixing clip 523 by the grabbing grooves 5235.

The grabbing grooves 5235 may be defined by forming the top and bottom ends of the fixing clip 523 to be concave, forming the fixing clip 523 in the shape of a wave, or forming the fixing clip 523 to be continuously convex upward and downward.

The fixing body 521 may include a first fixing body 5211 engaged with the door or the first chamber, a second fixing body 5212 provided in front of the first fixing body 5211, apart therefrom, and a compression spring 5213 between the first fixing body 5211 and the second fixing body 5212, to push the second fixing body 5212 toward the fixing clip 523 and thus press the surface of the clothing item.

Referring to FIG. 9B, with the fixing clip 523 fixed, the second fixing body 5212 may move back and forth. Therefore, the user may form a gap or space between the fixing clip 523 and the second fixing body 5212 by pushing back the second fixing body 5212, and then placing the clothing item C between the second fixing body 5212 and the fixing clip 523.

Thereafter, when external force is released from the second fixing body 5212, the second fixing body 5212 may move toward the fixing clip 523, thereby fixedly pressing the clothing item C to the fixing clip 523.

To prevent the second fixing body 5212 from irregularly vibrating or moving, the first fixing body 5211 may be configured to accommodate the second fixing body 5212.

In some embodiments, the first fixing body 5211 may be extended from the outer circumferential surface thereof to accommodate the outer circumferential surface of the second fixing body 5212 and hence guide ribs 521*b* that guide the movement of the second fixing body 5212.

The second fixing body 5212 may further include accommodation ribs 521*a* accommodated in the guide ribs 521*b*, to increase a contact area.

Now, a description will be given of another exemplary embodiment of the laundry treating apparatus according to the present disclosure with reference to FIGS. 10 to 17.

Figure 10:
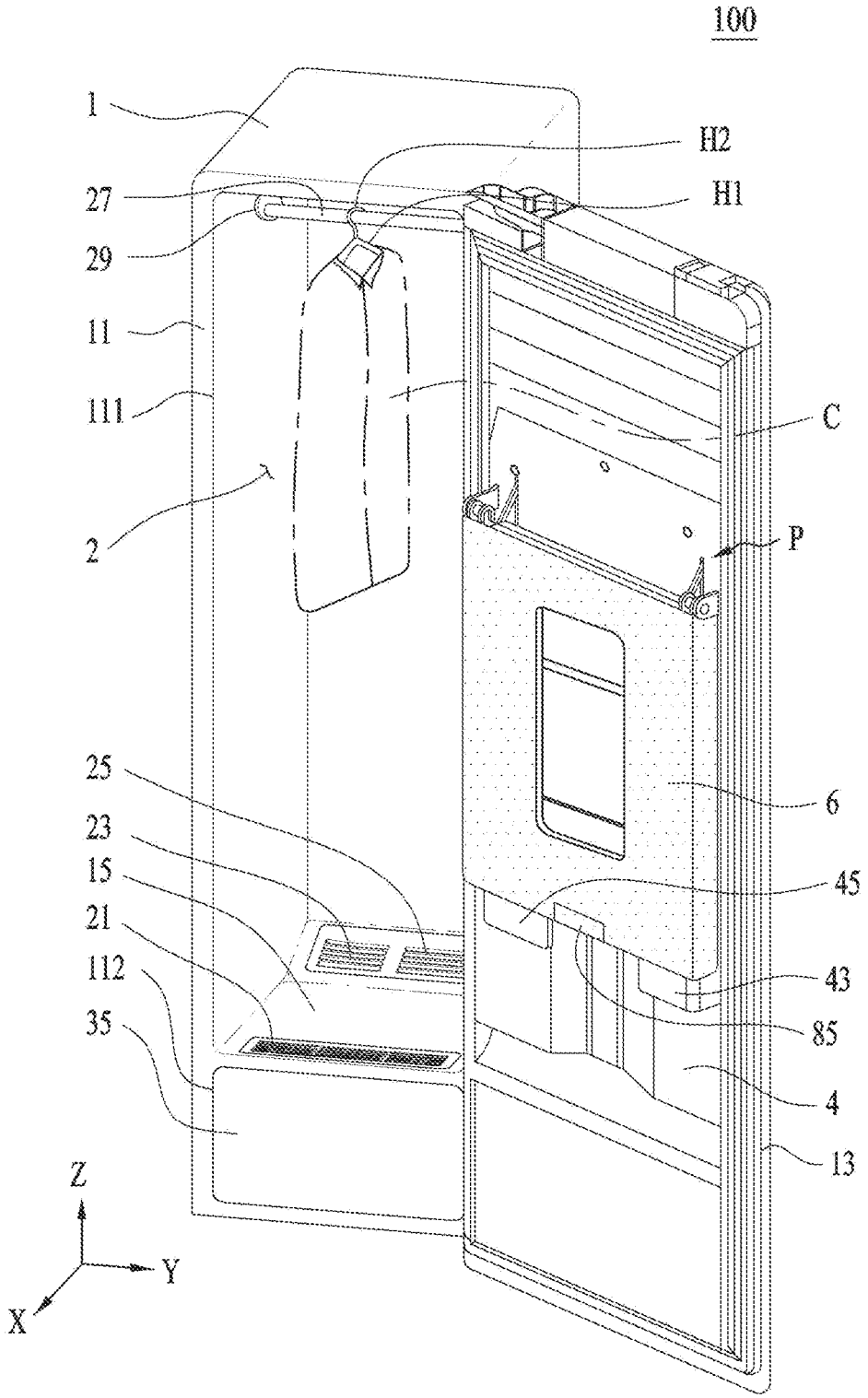
FIG. 10 illustrates an exemplary laundry treating apparatus, according to the embodiments of the present disclosure.
Figure 11:
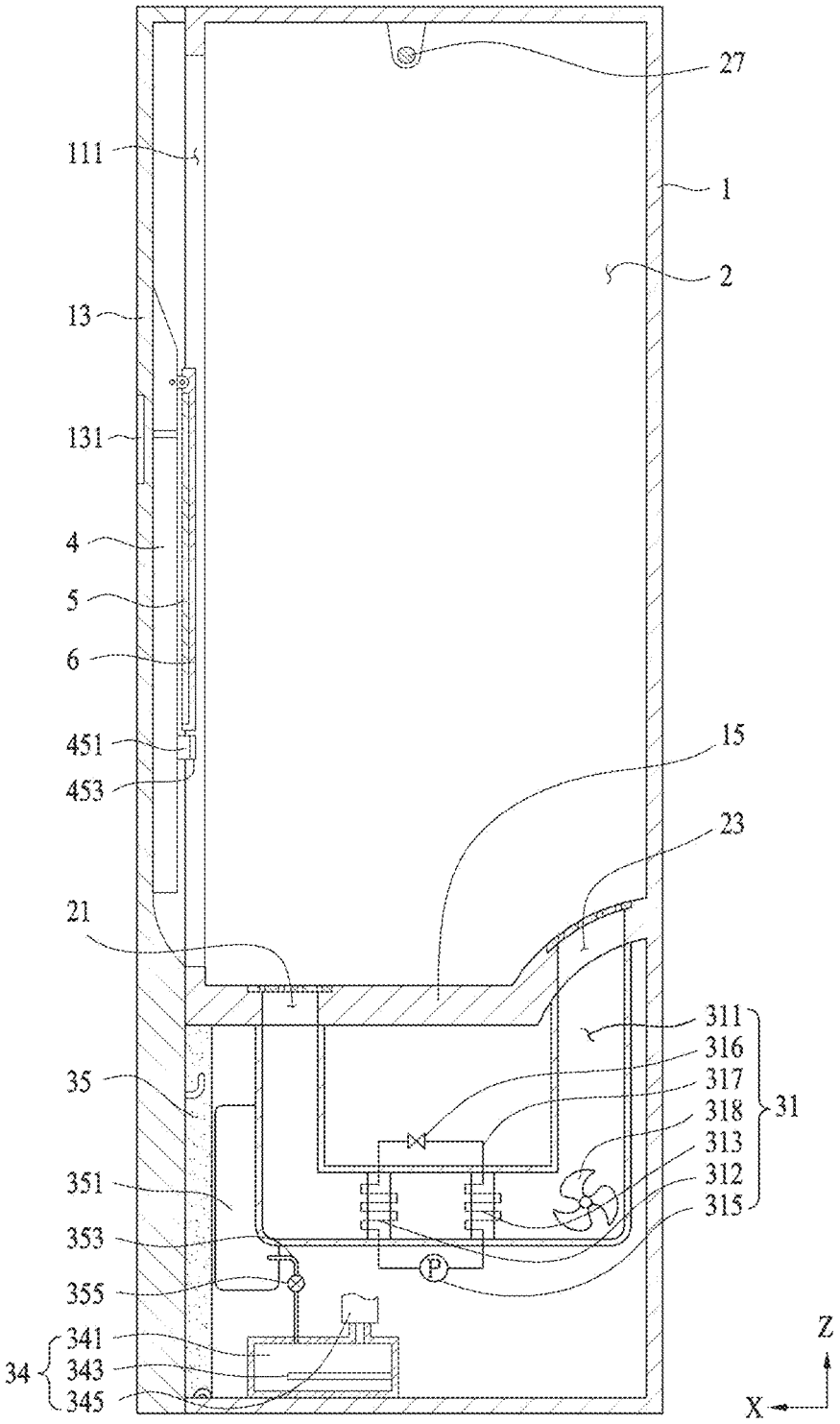
FIG. 11 illustrate another exemplary laundry treating apparatus, according to the embodiments of the present disclosure.

As illustrated in FIGS. 10 and 11, a laundry treating apparatus 100 according to the present disclosure may comprise a cabinet 1 forming the exterior of the laundry treating apparatus 100, a first chamber 2 (e.g., accommodation space) provided inside the cabinet 1 and configured to provide a space in which a clothing item is accommodated, supply portions configured to supply at least one of air or moisture to the first chamber 2, and a presser P provided inside the first chamber 2 and configured to freshen pleats and remove wrinkles on the clothing item.

The supply portions may be provided inside a second chamber 3. The second chamber 3 may reside inside the cabinet 1 and may define a space separated from the first chamber 2. FIG. 2 illustrates an example in which the second chamber 3 is positioned under the first chamber 2, separated from the first chamber 2 by a partition 15.

As illustrated in FIG. 10, the cabinet 1 may comprise a door 13 rotatable upon a rotation shaft provided along the height direction (Z-axis direction) of the cabinet 1 in receding and approaching directions from and to a front surface 11 of the cabinet 1. The first chamber 2 may communicate with the outside through an inlet 111 formed on the front surface 11, and the second chamber 3 may communicate with the outside through a communication opening 112 provided on the front surface 11. The communication opening 112 may be opened or closed by a second chamber door 35 detachably coupled with the cabinet 1. When the door 13 rotates, receding from the front surface 11, both the inlet 111 and the second chamber door 35 may be exposed outward at the same time.

A hanger support unit may further be included in the first chamber 2 to support clothing items. The hanger support unit may comprise a support bar 27 provided in the width direction (Y-axis direction) or depth direction (X-axis direction) of the first chamber 2, and may support bar-fixing portions 29 configured to fix both ends of the support bar 27 to the ceiling surface of the first chamber 2.

The support bar 27 may be configured to support a hanger hook H2, and the clothing item Chung on a hanger H1 may be kept spread inside the first chamber 2 by the support bar 27.

The supply portions may include at least one of an air feeder 31 configured to supply heated or unheated air into the first chamber 2 or a moisture feeder 34 configured to supply stream or mist into the first chamber 2. In some embodiments, the supply portions may include both of the air feeder 31 and the moisture feeder 34, as illustrated in FIG. 10.

The air feeder 31 may include a duct 311 which may be configured to discharge air inside the first chamber 2 to the outside of the first chamber 2 and then guide the air again into the first chamber 2, and a heat exchange unit which may be configured to exchange heat with air flowing along the duct 311.

The first chamber 2 and the second chamber 3 may communicate with each other through a discharge outlet 21 and a supply inlet 23 which may penetrate through the partition 15. The duct 311 may have one end coupled to the discharge outlet 21 and the other end coupled to the supply inlet 23. In some embodiments, the duct 311 may be provided inside the second chamber 3.

The heat exchange unit may include a fan 318 configured to rotate inside the duct 311, and a heat pump configured to dehumidify and then heat air introduced into the duct 311.

The heat exchange unit with the heat pump may include a refrigerant pipe 317 which may be configured to provide a circulation passage for refrigerant, a first heat exchanger (evaporator) 312 fixed to the refrigerant pipe 317 and disposed between the discharge outlet 21 and the fan 318, a second heat exchanger (condenser) 313 fixed to the refrigerant pipe 317 and disposed between the first heat exchanger 312 and the fan 318, a compressor 315 configured to enable circulation of the refrigerant along the refrigerant pipe 317, and an expander 316 configured to reduce the pressure of the refrigerant passed through the second heat exchanger 313.

The first heat exchanger 312 and the second heat exchanger 313 may reside inside the duct 311, and the compressor 315 and the expander 316 may reside outside the duct 311. casein some embodiments, the compressor 315 and the expander 316 may be located at positions where the compressor 315 and the expander 316 are exposed outward, when the second chamber door 35 opens the communication opening 112.

The first heat exchanger 312 may be configured to absorb heat from the air introduced into the duct 311 and transfer the heat to the refrigerant circulating inside the refrigerant pipe 317. While passing through the first heat exchanger 312, the refrigerant may evaporate and the air may be condensed (dehumidified).

The second heat exchanger 313 may be configured to transfer heat from the refrigerant discharged from the compressor 315 to the air passed through the first heat exchanger 312. While passing through the second heat exchanger 313, the refrigerant may be condensed, and the air may be heated.

FIG. 11 illustrates an exemplary embodiment in which the moisture feeder 34 resides inside the second chamber 3 and supplies steam to the first chamber 2. In some embodiments, the moisture feeder 34 may include a storage 341 inside the second chamber 3, a heater 343 inside the storage 341, and a feed pipe 345 configured to couple the storage 341 to the first chamber 2.

The storage 341 may store water, and the heater 343 may be configured to heat the water stored in the storage 341 to steam. The feed pipe 345 may be configured to guide the steam from the storage 341 to the first chamber 2. The feed pipe 345 may have one end fixed to the storage 341 and the other end coupled to a moisture feed hole 25 (see FIG. 10) penetrating through the partition 15.

The storage 341 may receive water from a tank 351 fixed to the second chamber door 35. In some embodiments, the tank 351 may be detachably mounted to the second chamber door 35. The tank 351 may be coupled to the storage 341 through a connection pipe 353, and the connection pipe 353 may be opened and closed by a valve 355.

To allow the water stored in the tank 351 to flow to the storage 341 by opening the valve 355 in spite of the absence of a pump, the tank 351 may be located higher than the storage 341.

In other embodiments, the moisture feeder 34 according to the present disclosure may supply mist. In this case, the moisture feeder 34 may include a storage configured to store water, a vibrator configured to generate mist by vibrating the water stored in the storage, and a feed pipe configured to guide the mist from the storage to the moisture feed hole 25.

The door 13 may be provided with a control panel 131. The control panel 131 may include an input unit configured to receive a control command required to operate the air feeder 31 and the moisture feeder 34, and a display configured to display user-selectable control commands or information related to operation of the laundry treating apparatus.

The laundry treating apparatus 100 having the above-described structure may hold a clothing item secured to a hanger on the support bar 27 and may sequentially supply moisture and heated air (or hot air) to the clothing item through the moisture feeder 34 and the air feeder 31. Therefore, compared to a conventional laundry treating apparatus that deodorizes or removes wrinkles out of clothes by supplying hot air or steam to a rotating drum, the embodiments of the present disclosure may prevent wrinkles on a clothing item by maintaining the clothing item spread inside the first chamber 2 during supply of moisture and hot air.

The presser P of the present disclosure may be disposed at any position in the first chamber 2. That is, the presser P may be mounted on any surface of the first chamber 2. The presser P is mounted on the inner surface of the door 13 (one of the surfaces forming the first chamber 2) in FIG. 11, by way of example. While only a single presser P is illustrated in FIG. 11, the laundry treating apparatus 100 of the present disclosure may include two or more pressers P.

As illustrated in FIG. 12, the presser P according to the present disclosure may comprise a base 4 on one of the surfaces forming the first chamber 2, a pressing portion 6 configured to rotate upon an engagement unit 510 (or a rotation shafts) extending along the width direction of the base 4 (e.g., the Y-axis direction, the width direction of the cabinet 1, or the width direction of the first chamber 2), and a support unit 5 interposed between the base 4 and the pressing portion 6, which may be rotatable upon the rotation shafts extending along the width direction of the base 4 to thereby fix clothes.

Figure 13:
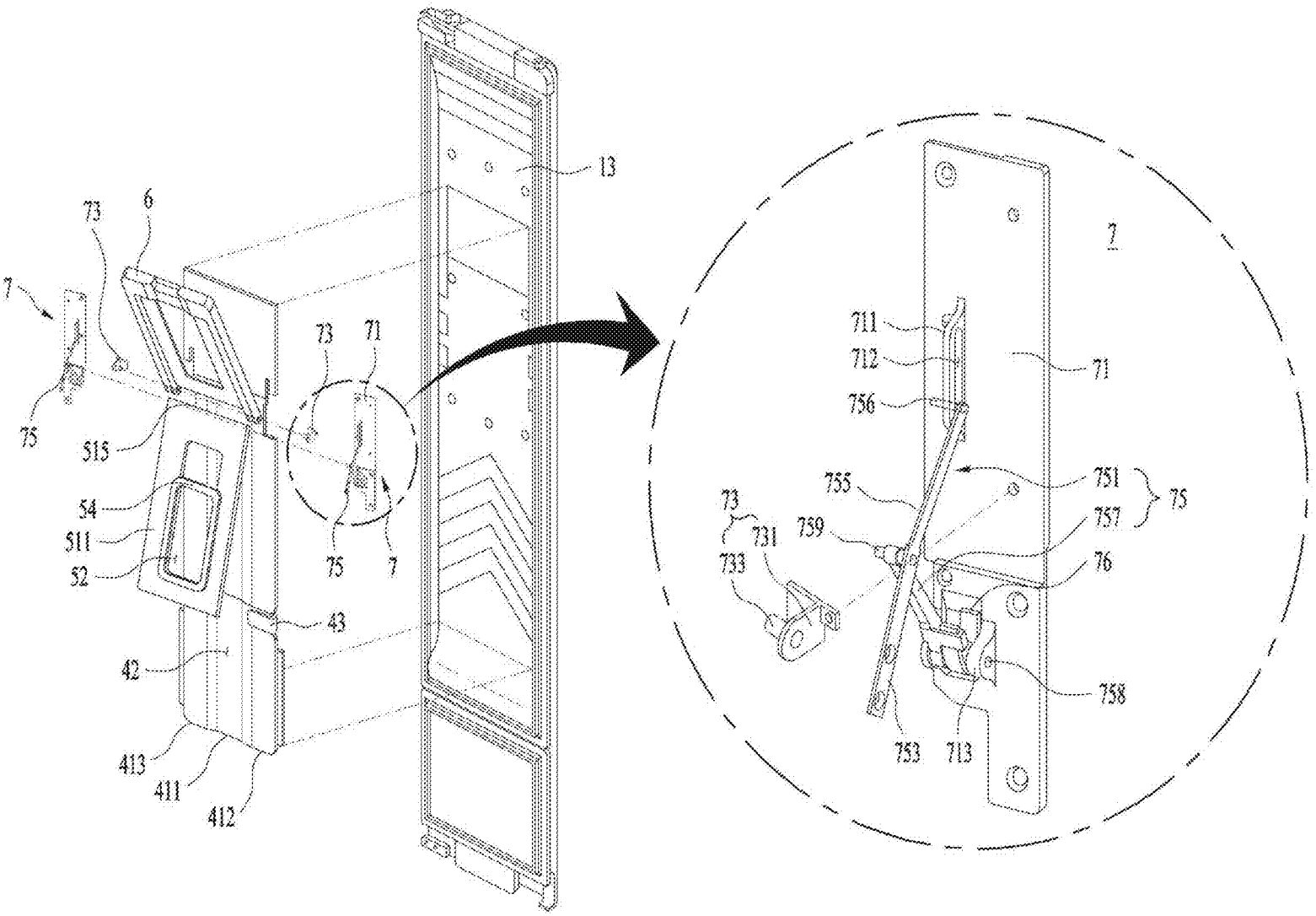
FIG. 13 illustrates another exemplary presser, according to the embodiments of the present disclosure.

The base 4 may be provided as one of the surfaces forming the first chamber 2 or as a board fixed onto one of the surfaces forming the first chamber 2. FIG. 13 illustrates an exemplary embodiment in which the base 4 includes the base bodies 41 in the form of boards fixed to the inner surface of the door 13 forming the first chamber 2. For the convenience of description, the following description is given with the appreciation that the base 4 is fixed on the inner surface of the door 13, by way of example.

As illustrated in FIG. 13, a base body 41 may be formed into a square with a width (e.g., a length in the Y-axis direction) shorter than a height (e.g., a length in the Z-axis direction). The base body 41 may include a fixing portion 411 fixed to the door 13, and first and second extension portions 412 and 413 extending on the left and right sides of the fixing portion 411, respectively.

Unlike the fixing portion 411, free ends of the first and second extension portions 412 and 413 may be apart from the inner surface of the door 13. Since a clothing item fixed to the support unit 5 may be pressed between the support unit 5 and the base 4 as described later, the free ends of the first and second extension portions 412 and 413 apart from the inner surface of the door 13 may enable effective pressing of the clothing item. This is because each of the extension portions 412 and 413 may serve as a kind of plate spring configured to press the clothing item toward the support unit 5.

The base body 41 may further include the base recess 42 which may be configured to provide a space in which a sewing line of the clothing item is accommodated. The base recess 42 may be formed by making the surface of the fixing portion 411 concave or as a space defined by setting the distance between the inner surface of the door 13 and the surfaces of the extension portions 412 and 413 to be larger than the distance between the inner surface of the door 13 and the surface of the fixing portion 411.

The base 4 may further include guides 43 and 45 provided on the inner circumferential surface of the door 13 or on the base body 41, to fix the clothing item on the base body 41. FIG. 12 illustrates an exemplary embodiment in which the guides may comprise a first guide 43 and a second guide 45 fixed to the base body 41.

The first guide 43 may include a first fixing body 451 protruding from the first extension portion 412, and a first extension body 453 protruding from a free end of the first fixing body 431 toward the second guide 45 (see FIG. 15). The second guide 45 may include a second fixing body 451 protruding from the second extension portion 413, and a second extension body 453 protruding from a free end of the second fixing body 451 toward the first guide 43 (see FIG. 12).

The support unit 5 may include a support body 51 between the base body 41 and the pressing portion 6. The support body 51 may be fixed to the inner circumferential surface of the door 13 through a pair of hinge units 7. The hinge units 7 may provide a rotation shaft along the width direction of the base 4 to the support body 51. Therefore, the support body 51 may be rotatable in receding and approaching direction from and to the base body 41. The structure of the hinge units 7 will be described later.

Figure 14:
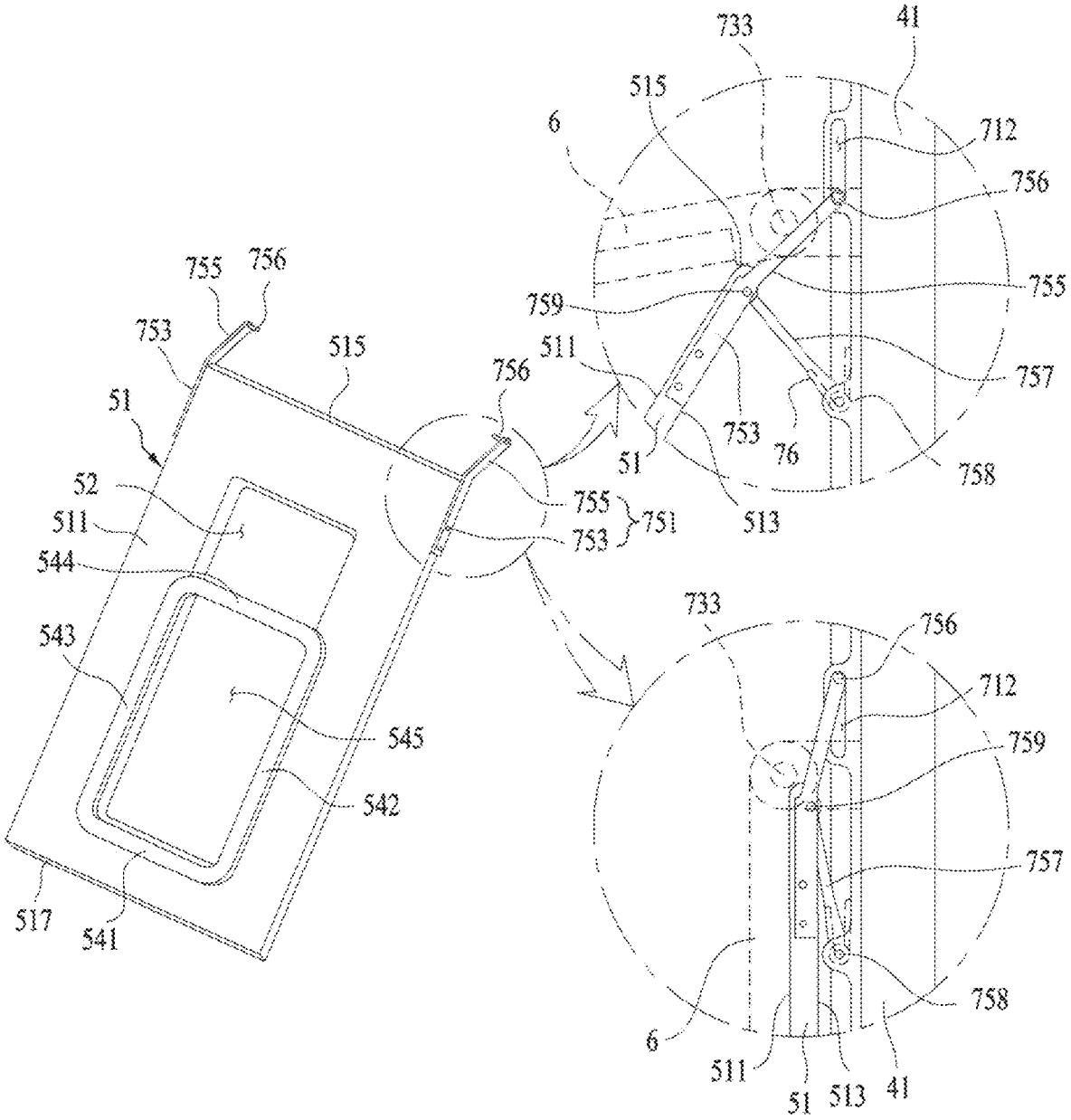
FIG. 14 illustrates an exemplary support unit and pressing portion in the presser, according to the embodiments of the present disclosure.

As illustrated in FIG. 14, the support body 51 may be formed in the shape of a board, comprising a mounting surface 511, a pressing surface 513, a support surface 515, and a bottom surface 517. The mounting surface 511 may comprise a surface facing the pressing portion 6, and the pressing surface 513 may face the base body 41. The bottom surface 517 may comprise a surface on a bottom end of the support body 51, and the support surface 515 may comprise a surface on a top end of the support body 51.

A clothing item may be hung on the support surface 515 located on the top end of the support body 51, with one end thereof positioned on the mounting surface 511 and the other end positioned in a space between the pressing surface 513 and the base body 41. Therefore, the support surface 515 may be defined as a means for fixing a clothing item to the presser P.

The mounting surface 511 may include a clothes fixing portion 54 configured to fix one end of the clothing item to the fixing body 51. As far as the clothes fixing portion 54 executes the above function, the clothes fixing portion 54 may be configured in various shapes. FIG. 14 illustrates an exemplary embodiment in which the clothes fixing portion 54 is configured to fix a clothing item to the fixing body 51 by elastic force.

In FIG. 14, the clothes fixing portion 54 may include a first fixing-portion body 541 in the form of a bar along the width direction of the support body 51, second and third fixing-portion bodies 542 and 543 extending from both ends of the first fixing-portion body 541 along the height direction of the support body 51, and a fourth fixing-portion body 544 configure to couple the second fixing-portion body 542 to the third fixing-portion body 543.

The second fixing-portion body 542, the third fixing-portion body 543, and the fourth fixing-portion body 544 may contact the support body 51 without being fixed to the support body 51. Therefore, the user may fix a clothing item to the fixing body 51 by inserting one end of the clothing item into a space between the fourth fixing-portion body 544 and the support body 51, a space between the second fixing-portion body 542 and the support body 51, and a space between the third fixing-portion body 543 and the support body 51.

The support unit 5 may further include a support-unit through hole 52 penetrating through the support body 51. In this case, the second fixing-portion body 542 and the third fixing-portion body 543 may be positioned on both side surfaces of the support-unit through hole 52, for example, on the mounting surface 511. As such, if the second fixing-portion body 542 and the third fixing-portion body 543 are positioned inside the support-unit through hole 52, the clothes fixing portion 54 may not fix the clothing item on the mounting surface 511.

Since a fixing-body through hole 545 may be formed at the center of the clothes fixing portion 54 including the above-described bodies 541, 542, 543, and 544, and the support-unit through hole 52 may be formed on the support body 51, under the fixing-body through hole 545, air or moisture may be supplied to the base body 41 through the fixing-body through hole 545 and the support-unit through hole 52.

Figure 15A:
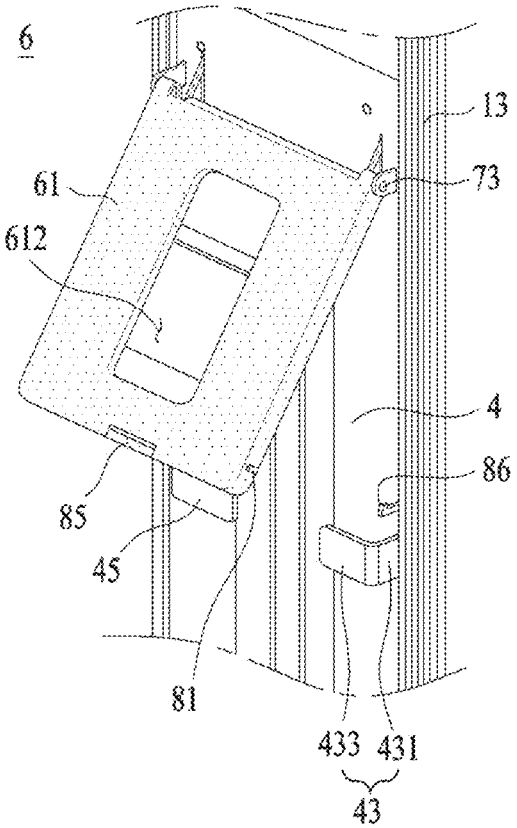
FIGS. 15A-15B illustrate another exemplary support unit and pressing portion in the presser, according to the embodiments of the present disclosure.
Figure 15B:
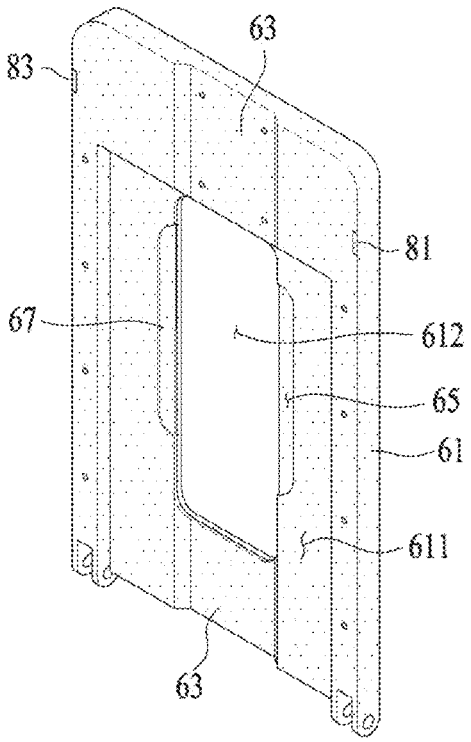

As illustrated in FIGS. 15A-15B, the pressing portion 6 may include the pressing body 61 rotatable in the receding and approaching directions from and to the base body 41. The pressing body 61 may be fixed to the inner circumferential surface of the door 13 through the hinge units 7.

The pressing body 61 may comprise a pressing-unit through hole 612 configured to penetrate through the pressing body 61. The pressing-unit through hole 612 may be configured to communicate with the fixing-body through hole 545 and the support-unit through hole 52. Therefore, air and moisture inside the first chamber 2 may be supplied to the base body 41 through the pressing-unit through hole 612, the fixing-body through hole 545, and the support-unit through hole 52.

A support-unit accommodation recess 611 configured to provide a space in which the support body 51 may be accommodated, and fixing-unit accommodation recesses 65 and 67 configured to provide a space in which the clothes fixing portion 54 may be accommodated may be provided on one surface of the pressing body 61, facing the support body 51.

The support-unit accommodation recess 611 may be formed on the one surface of the pressing body 51, facing the support body 51, and may accommodate the entire mounting surface 511 of the support body 51.

The fixing-unit accommodation grooves may be provided in the support-unit accommodation recess 611, and may include a second body accommodation recess 65 configured to accommodate the second fixing-portion body 542 and a third body accommodation recess 67 configured to accommodate the third fixing-portion body 543.

A pressing-unit recess 63 may further be formed on the one surface of the pressing body 61, facing the support body 51, configured to prevent a sewing line of a clothing item from being pressed by the pressing body 61. The pressing-unit recess 63 may be formed along the height direction of the support body 51. A clothing item, such as pants, may comprise sewing lines. The foregoing pressing-unit recess 63 and the base recess 42 may be configured to prevent formation of an unnecessary crease on a clothing item, caused by a sewing line.

The pressing portion 6 may be detachably fixed to the base body 41 or the inner circumferential surface of the door 13 by a pressing-body fixing portion 8. FIGS. 15A-15B illustrate an exemplary embodiments of the pressing body fixing portion 8 that is configured to fix the pressing body 61 to the inner circumferential surface of the door 13.

The pressing-body fixing portion 8 may include first and second fasteners 81 and 83 provided on the pressing body 61, a third fastener 86 to be engaged with the first fastener 81, and a fourth fastener 87 to be engaged with the second fastener 83.

The third fastener 86 and the fourth fastener 87 may comprise hooks protruding from the inner circumferential surface of the door 13, and the first fastener 81 and the second fastener 83 may comprise grooves formed on the pressing body 61, to accommodate the hooks.

Further, the first fastener 81 may be provided rotatably on the pressing portion 61 and may be detachably engaged with the third fastener 86, and the second fastener 82 may be provided rotatably on the pressing portion 61 and may be detachably engaged with the fourth fastener 87. In this case, the first fastener 81 and the second fastener 83 may be rotated by a handle 85 rotatably provided on the pressing body 61.

The pressing portion 6 and support unit 5 may be rotatably fixed to the base body 41 or the inner circumferential surface of the door 13 by a pair of hinge units 7. FIG. 13 illustrates an exemplary embodiment in which the pressing portion 6 and the support unit 5 are fixed to the door 13 by the hinge units 7 fixed on the inner circumferential surface of the door 13.

As illustrated in FIG. 13, each of the hinge units 7 may include a unit body 71 fixed to the base body 41 or the inner circumferential surface of the door 13, a pressing-unit hinge 73 fixed to the unit body 71 and configured to form a rotation shaft of the pressing body 61, and a support-unit hinge 75 fixed to the unit boy 61 and configured to form a rotation shaft of the support body 51.

The pressing-unit hinge 73 may include a hinge body 731 fixed to the unit boy 71, and a pressing-body rotation shaft 733 provided on the hinge body 71, to which the pressing body 61 may be rotatably coupled.

As illustrated, a pair of pressing-unit hinges 73 may be provided. Therefore, a pair of pressing-body rotation shafts 733 may provide a rotation shaft extending in the width direction of the door 13 (the width direction of the base body 41 or the Y-axis direction) to the pressing body 61.

The support-unit hinge 75 may be configured to rotate the support body 51 in a receding direction from the base body 41 and in an approaching direction to the base body, upon the rotation shaft along the width direction of the door 13. The support-unit hinge 75 may include a first link 751 and a second link 757.

The unit body 71 may include a slit body 711 protruding toward the first chamber 2 (in a receding direction from the door 13) and a shaft fixing portion 713 to which one end of the second link 757 may be rotatably fixed. The shaft fixing portion 73 may be positioned under a slit 712, and the slit body 711 may be provided with the slit 712 formed along the height direction of the door 13.

In some embodiments, the first link 751 may be formed into a bar with one end fixed to the support body 51 and the other end inserted into the slit 712. For example, the first link 751 may include a first bar 753 fixed to the support body 51, and a second bar 755 with one end coupled to the slit 712 and the other end coupled to the first bar 753. The second bar 755 may be provided, at one end thereof, with a link shaft 756 which may be inserted into the slit 712 and may make a reciprocating motion along the slit 712.

The second link 757 may be formed into a bar with one end rotatably fixed to the shaft fixing portion 713 and the other end rotatably coupled with the first link 751 or the support body 51. FIG. 13 illustrates an exemplary embodiment of the second link 757 with one end coupled to the shaft fixing portion 713 by a first connection shaft 758 and the other end connected to the first link 751 by a second connection shaft 759.

As illustrated in FIG. 14, the second link 757 may be rotatable toward the unit body 71 (e.g., toward the base 4) and from the unit body 71 (e.g., from the base 4).

When the support body 51 rotates in the receding direction from the base body 41, the second link 757 may rotate in the receding direction from the base body 41, and the link shaft 756 of the first link 751 may move toward a bottom end of the slit 712 by the second link 757. In this process, since the support surface 515 of the support body moves farther from the base body 41, a space enough to allow a clothing item to pass may be formed between the support surface 515 and the base body 41. Therefore, when the support body 51 rotates in the receding direction from the base body 41, the second bar 755 of the first link 751 may be configured to form a space into which the clothing item may be inserted, between the support surface 515 and the base body 41.

When the support body 51 rotates toward the base body 41, the second link 757 may rotate toward the base body 41, and the link shaft 756 may move toward a top end of the slit 712 by the second link 757. In this case, the support surface 515 may move toward the base body 41.

The support-unit hinge 75 may further include a manipulator 76 configured to enable self-rotation of the support body 51 in the receding direction from the base body 41. The manipulator 76 may be a compression spring with one end fixed to the second link 757 and the other end fixed to the unit boy 71. As far as when the second link 757 rotates toward the base body 41, the compression spring may be compressed and when external force is released from the second link 757, the compression spring can rotate the second link 757 to rotate in the receding direction from the base body 41, the compression spring may have any structure. When the user rotates the pressing body 61 in the receding direction from the base body 41, the support body 51 may be configured to rotate in the receding direction from the base body by the manipulator 76, thereby automatically forming a space enough to allow a clothing item to pass between the support surface 515 and the base body 41. Accordingly, the manipulator 76 may be configured to enhance user convenience.

With reference to FIGS. 10, 12 and 16, an exemplary operation of the presser P will be described below.

In FIG. 10, the pressing body 61 is fixed to the inner circumferential surface of the door 13 by the pressing-body fixing portion 8. The user may separate the pressing body 61 from the pressing-body fixing portion 8 by handle 85 and then rotate the pressing body 61 in the receding direction from the base body 41.

Referring to FIG. 12, when the user rotates the pressing body 61 in the receding direction from the base body 41, the support body 51 may rotate in the receding direction from the base body 41 by the manipulator 76. Then, a space large enough to allow a clothing item to pass may be formed between the support surface 515 of the support body 51 and the base body 41.

Figure 16A:
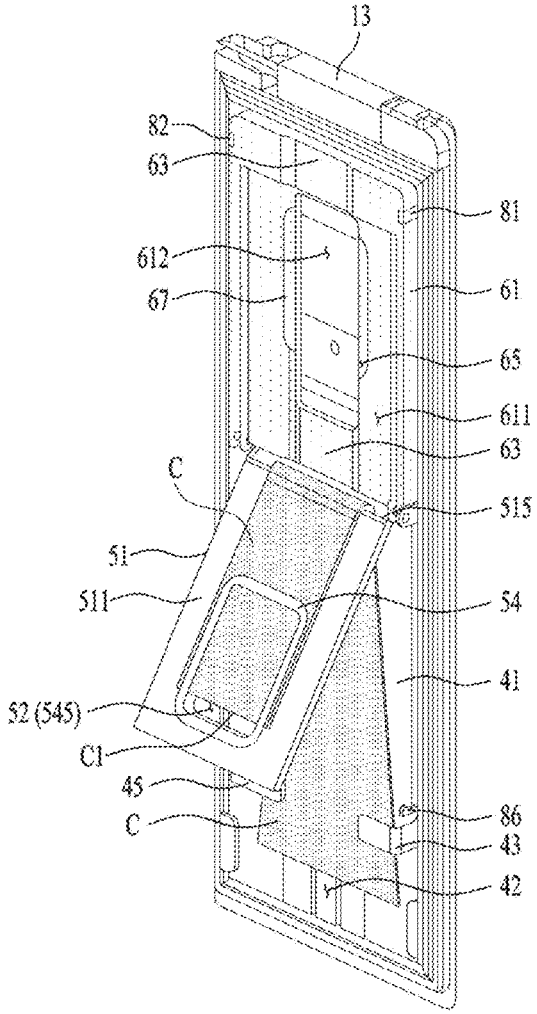

Referring to FIG. 16A, the user may insert the clothing item C into the space formed between the support surface 515 and the base body 41 and fix one end Cl of the clothing item C to the clothes fixing portion 54. Then, a part of the clothing item C may be supported on the mounting surface 511, and the remaining part of the clothing item C may be positioned between the pressing surface 513 and the base body 41.

Thereafter, the user may insert the clothing item positioned between the pressing surface 513 and the base body 41 into the guides 41 and 43, thereby completing fixation of the clothing item C to the presser P.

Figure 16B:
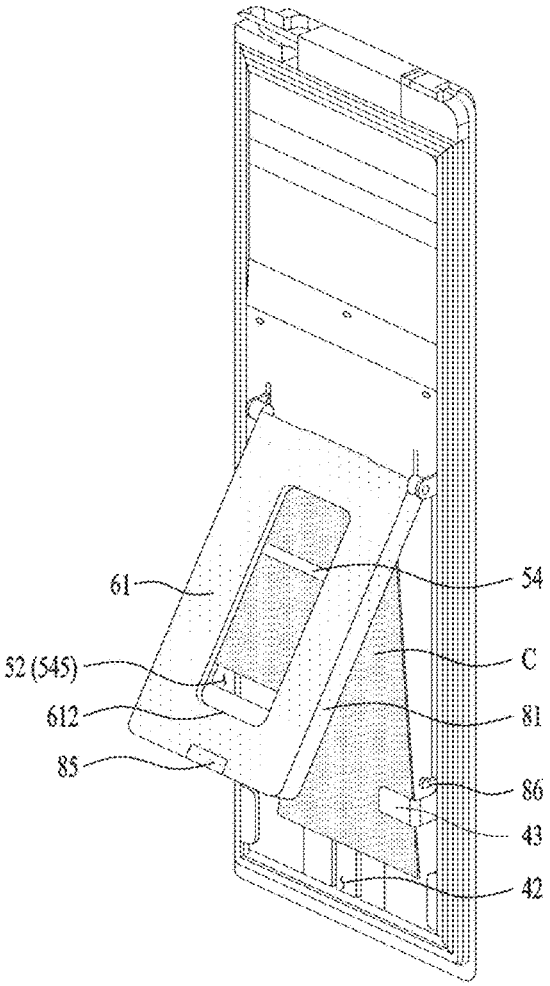

Referring to FIG. 16B, once the clothing item C is fixed to the presser P, the user may engage the pressing body 61 with the pressing-body fixing portion 8 by rotating the pressing body 61 toward the base body 41. The support body 51 may rotate toward the base body 41 by the pressing body 61. The clothing item C may be pressed between the pressing surface 513 of the support body 51 and the pressing body 61 as well as between the pressing surface 513 of the support body 51 and the base body 41.

In this state, a controller (not shown) may sequentially or simultaneously operate the moisture feeder 34 and the air feeder 31. Moisture supplied into the first chamber 2 by the moisture feeder 34 may move to the base body 41, thereby reaching the clothing item C in the present disclosure.

The air feeder 31 may be configured to supply hot air with low humidity. Therefore, once the air feeder 31 operates, moisture supplied to the clothing item C may evaporate. Since smell particles are also evaporated from the clothing item C during evaporation of the moisture, the clothing item C may also be deodorized in the present disclosure.

Further, when moisture feeding and air feeding are performed during pressing of the clothing item C by the presser P, pleats designed on the clothing item C may be freshened and wrinkles may be removed from the clothing item C.

A part of the clothing item may be positioned on the mounting surface 511 of the support body 51 and the remaining part of the clothing item may be positioned on the pressing surface 513 of the support body 51 in the presser P having the above-described structure. Therefore, the entire clothing item C may be pressed, while the lengths of the base body 41, the support body 51, and the pressing body 61 may be minimized.

That is, if the presser P is configured to support or press a clothing item by only one of the mounting surface 511 and the pressing surface 513 of the support body 51, the base body 41, the support body 51, and the pressing body 61 may be longer. However, the presser P of the present disclosure may overcome the problem of the increased lengths of the bodies 41, 51 and 61.

Further, since the pressing body 61 and the support body 51 may be rotatable toward the base body 41 upon the rotation shaft extending along the width direction of the base body 41 in the presser P of the present disclosure, the problem that the support body 51 and the pressing body 61 may form wrinkles on a clothing item may be overcome.

If the pressing body 61 and the support body 51 are configured to rotate upon the rotation shafts extending along the height direction of the door 13, when the support body 51 rotates toward the base body 41, the support body 51 and the base body 41 may generate wrinkles on a clothing item. Since the distance between the support body 51 and the base body 41 may decrease toward the rotation shafts, the clothing item may be pushed in an opposite direction to the rotation shafts and wrinkled during rotation of the support body 51 toward the base body 41. However, this problem may be overcome by rotating the pressing body 61 and the support body 51 upon the rotation shafts extending along the width direction of the base body 41.

Figure 17:
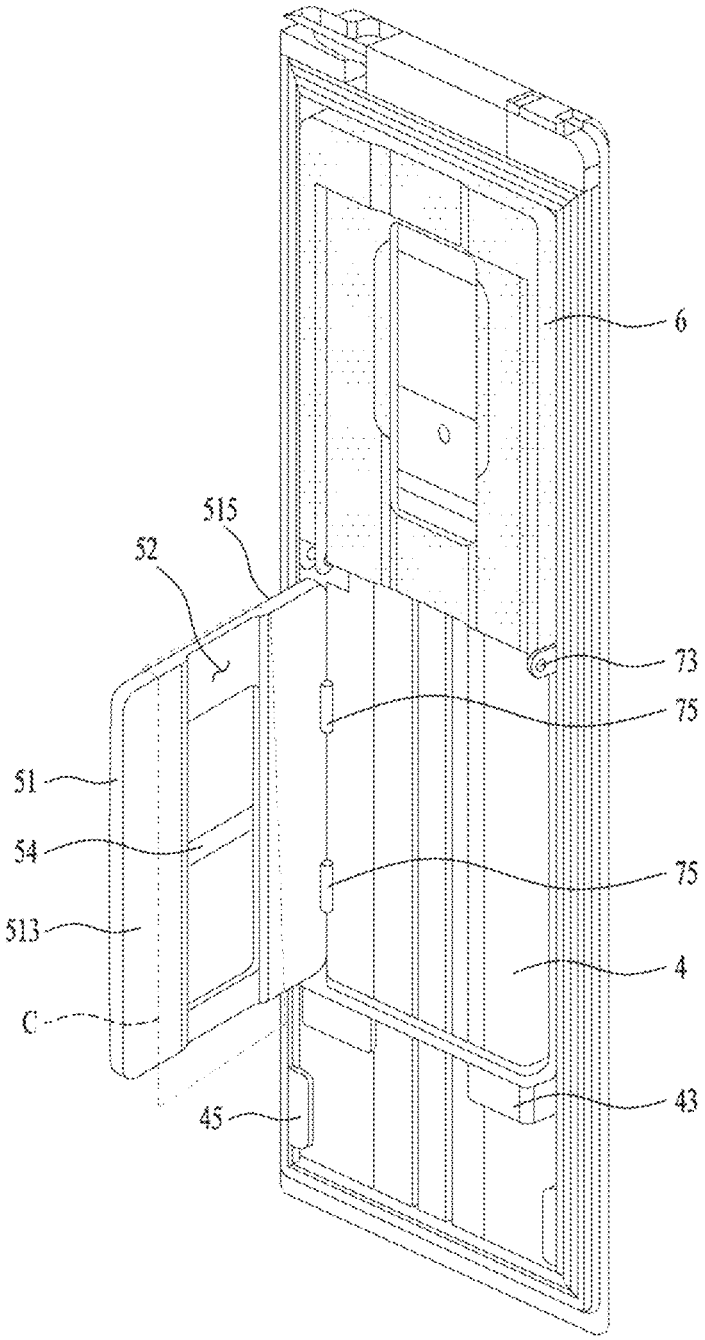
FIG. 17 illustrates another exemplary presser, according to the embodiments of the present disclosure.

FIG. 17 illustrates another exemplary embodiment of the presser P. In the presser P according to this embodiment, the support body 51 may be rotatable in the receding and approaching directions from and to the base body 41, upon a rotation shaft extending along the height direction of the base body 41 (e.g., the height direction of the door). That is, the support body 51 may be fixed to the door 13 by the support-unit hinges 75 arranged along the height direction of the base body 41 in this embodiment.

As is apparent from the foregoing description, the present disclosure may provide a laundry treating apparatus configured to prevent deformation or displacement of a clothing item by pressing the clothing item in a length direction.

The present disclosure may provide a laundry treating apparatus configured to enable a user to control an area to be pressed by controlling a hanging height of a clothing item.

The present disclosure may provide a laundry treating apparatus configured to maximize a pressing effect by expanding a pressed area of a clothing item.

The present disclosure may provide a laundry treating apparatus configured to prevent displacement of a clothing item even though the clothing item is fixed and pressed.

The present disclosure may provide a laundry treating apparatus configured to facilitate withdrawal and removal of a clothing item even though the clothing item is fixed with higher fixing force.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A laundry treating apparatus comprising:

a cabinet including an inlet located on a front thereof;

a door rotatably coupled to the cabinet and configured to open and close the inlet;

a first chamber located in the cabinet, the first chamber defining an accommodation space configured to accommodate a clothing item therein;

a supply portion configured to supply at least one of air or moisture into the accommodation space; and a presser located on the door, the presser being configured to hold or press the clothing item, the presser including:

a rotation shaft extending along a width direction of the door;

a base provided at an inner surface of the door;

a pressing body configured to rotate about the rotation shaft, the pressing body being rotatable with respect to the base and configured to press the clothing item positioned between the base and the pressing body; and a support body disposed between the base and the pressing body to press the clothing item.

2. The laundry treating apparatus according to claim 1, wherein the support body is provided to rotate towards or away from the pressing body.

3. The laundry treating apparatus according to claim 2, wherein the presser further comprises a second rotation shaft extending along a height direction of the door, the support body configured to rotate about the second rotation shaft.

4. The laundry treating apparatus according to claim 1, wherein the support body is provided to rotate towards or away from the base.

5. The laundry treating apparatus according to claim 1, wherein the support body is configured to rotate above the base.

6. The laundry treating apparatus according to claim 1, wherein the support body is configured to be able to rotate up and down relative to the base.

7. The laundry treating apparatus according to claim 6, wherein the support body is configured to fold a part of the clothing item located higher than the base.

8. The laundry treating apparatus according to claim 6, wherein the support body includes a support surface configured to support the clothing item in the width direction of the door.

9. The laundry treating apparatus according to claim 8, wherein the support body is configured to fold the clothing item relative to the support surface.

10. The laundry treating apparatus according to claim 1, wherein the support body is configured to fold the clothing item.

11. The laundry treating apparatus according to claim 1, wherein the support body includes:

a first surface configured to press the clothing item to the pressing body; and a second surface configured to press the clothing item to the base.

12. The laundry treating apparatus according to claim 1, wherein the pressing body is configured to rotate to press the support body towards the base.

13. The laundry treating apparatus according to claim 1, wherein the pressing body includes a pressing-unit through hole on a surface of the pressing body, the pressing-unit through hole being configured to be spaced apart from a sewing line of the clothing item.

* * * * *